US007177578B2

(12) United States Patent
Nakamura et al.

(10) Patent No.: US 7,177,578 B2
(45) Date of Patent: Feb. 13, 2007

(54) PROCESS FOR CLEANING AND IMAGE FORMING APPARATUS THEREFOR

(75) Inventors: Yoshisada Nakamura, Shizuoka (JP); Yutaka Nogami, Kanagawa (JP); Yasushi Ohki, Kanagawa (JP)

(73) Assignees: Fuji Photo Film Co., Ltd., Kanagawa (JP); Fuji Xerox Co., Ltd., Tokyo (JP)

( * ) Notice: Subject to any disclaimer, the term of this patent is extended or adjusted under 35 U.S.C. 154(b) by 150 days.

(21) Appl. No.: 10/696,361

(22) Filed: Oct. 30, 2003

(65) Prior Publication Data

US 2004/0091295 A1 May 13, 2004

(30) Foreign Application Priority Data

Oct. 31, 2002 (JP) ..... 2002-318077

(51) Int. Cl.
*G03G 15/20* (2006.01)

(52) U.S. Cl. ..... 399/327; 399/329

(58) Field of Classification Search ..... 399/327, 399/328, 320, 329
See application file for complete search history.

(56) References Cited

U.S. PATENT DOCUMENTS 4,408,559 A * 10/1983 Sugiura ..... 399/327
5,138,390 A * 8/1992 Miyabayashi et al. ..... 399/327
5,649,130 A * 7/1997 Nakajima et al. ..... 399/327
6,094,559 A * 7/2000 Otsuka et al. ..... 399/327
6,097,926 A * 8/2000 Takagi et al. ..... 399/328
6,501,936 B1 * 12/2002 Sato ..... 399/320
6,795,661 B2 * 9/2004 Kanesawa et al. ..... 399/328
6,845,225 B2 * 1/2005 Toyoda et al. ..... 399/327
2001/0021491 A1 * 9/2001 Chen et al.
2002/0190060 A1 * 12/2002 Imai et al.

FOREIGN PATENT DOCUMENTS

JP 02160276 A * 6/1990
JP 05158375 A * 6/1993
JP 8-115033 A 5/1996
JP 9-40245 A 2/1997

* cited by examiner

*Primary Examiner*—Susan Lee
(74) *Attorney, Agent, or Firm*—Sughrue Mion, PLLC

(57) ABSTRACT

There is provided a process for cleaning wherein a cleaning sheet fed through an image forming apparatus is heated and pressured by at least one of a fixing belt and a fixing roller, and the cleaning sheet removes stains, wherein the cleaning sheet has a support and a layer containing a thermoplastic resin over the support, and satisfies at least one of the following formulae:

L1 (cm)>L2 (cm) and

L1 (cm)>L3 (cm)

wherein L1 is a length of the cleaning sheet in a direction of feeding the cleaning sheet, L2 a perimeter of the fixing roller, and L3 a perimeter of the fixing belt, and the process satisfies at least one of the following formulae:

L2 (cm)>L4 (cm) and

L3 (cm)>L4 (cm)

wherein L4 represents a length of a smallest electrophotographic image-receiving sheet in a direction of feeding the electrophotographic image-receiving sheet.

15 Claims, 5 Drawing Sheets

PROCESS FOR CLEANING AND IMAGE FORMING APPARATUS THEREFOR

BACKGROUND OF THE INVENTION

1. Field of the Invention

The present invention relates to cleaning processes which ensure easy cleaning of stains on a heating and pressuring member of an electrophotographic apparatus, and image forming apparatuses which employ such processes.

2. Description of the Related Art

Many suggestions have been made for electrophotographic image forming processes in which a roll of electrophotographic image-receiving sheet is used.

For example, Japanese Patent Application Laid-Open (JP-A) No. 05-208573 discloses using roll paper as printing paper in the printing step of a printing and bookbinding process by electrophotography in which image information is printed on the paper and subsequently binds a book.

In JP-A No. 06-27812, an electrophotographic apparatus is disclosed in which a cylindrical axis of a paper roll is unified with a toner containing part so that when the paper roll, which is one of consumables, is replaced with a new one, the toner containing part is also replaced, resulting in reducing the user's burden, improving the ease of maintenance, and enabling miniaturization of the apparatus.

Disclosed in JP-A No. 08-115033 is an electrophotographic recording apparatus which can use roll paper as recording paper and which can change transfer conditions between when using roll paper and when using cut sheet paper. With this recording apparatus, an advantage is that there is no need for being equipped with a special cleaning means because when the roll paper is being advanced, toner residue adhered to the apparatus is transferred to the recording paper which is advanced by a predetermined length.

JP-A No. 08-146831 discloses an electrophotographic transfer apparatus comprising a photoconductor, a means for feeding cut sheet transfer paper, a means for feeding roll transfer paper, a paper-feeding means detector for detecting which of the two paper-feeding means is being used, and a means for transferring an image on the transfer paper which is fed, wherein operating conditions for the transfer means are switched according to the paper-feeding means which is used.

However, in the above-mentioned technologies of prior art, toner or the thermoplastic resin of the toner image-receiving layer of an electrophotographic image-receiving sheet can easily offset onto the fixing member of an electrophotographic image forming apparatus, resulting in a problem that it is difficult to clean such offset toner or thermoplastic resin after they are fixed.

JP-A No. 09-40245 discloses a suggestion in which a roll of electrophotographic image-receiving sheet is used for cleaning. The suggestion describes a process in which an image is formed by electrophotography, and a portion of roll sheet paper which is pulled out from a roll of long sheet is used for cleaning residue toner on a photoconductor which has not been transferred by carrying out only a transfer operation.

However, the suggestion in the JP-A No. 09-40245 is a process for cleaning non-fixed toner on the photoconductor, and therefore its object differs by nature from cleaning the thermoplastic resin or toner which is offset and fixed.

SUMMARY OF THE INVENTION

An object of the present invention is to provide processes for cleaning which ensure easy cleaning of stains adhered on a heating and pressuring member on an electrophotographic apparatus by using a cleaning sheet which is an electrophotographic image-receiving sheet which has a toner image-receiving layer containing a thermoplastic resin, and image forming apparatuses which employ such processes.

To achieve the object, the inventors of the present invention discussed intensively, resulting in the following findings.

It was found that at a fixing process of an electrophotographic image-receiving sheet, the electrophotographic image-receiving sheet takes away the heat from a fixing roller, and therefore it is preferable that the perimeter of the fixing roller or perimeter of the fixing belt which is the heating and pressuring means be formed longer than the length of the electrophotographic image-receiving sheet in the direction of feeding the sheet.

In addition, since toner fixing properties change according to fixing temperatures, the temperature largely affects image quality. Therefore, this becomes a prominent requirement especially when using an electrophotographic image-receiving sheet which has a toner image-receiving layer containing a thermoplastic resin. This is because the thermoplastic resin contained in the toner image-receiving layer tends to be extruded toward the rear end of the electrophotographic sheet during fixing, and accordingly cause a problem in which the fixing roller or the fixing belt is stained at the portion where the rear edge of the electrophotographic image-receiving sheet touches the fixing roller or the fixing belt.

It was found that with the electrophotographic image-receiving sheet which has a toner image-receiving layer containing a thermoplastic resin, this thermoplastic resin can easily result in hot offset on a fixing roller or fixing belt, and when the thermoplastic resin offsets on the fixing member, cleaning it is not easy, and similarly, cleaning a toner resin is not easy when it offsets on the fixing member.

Accordingly, the inventors went through further intensive discussions based on the above findings, and as a result found out that cleaning can be carried out simply and definitely by using an electrophotographic image-receiving sheet which has a toner image-receiving layer containing a thermoplastic resin on a support as a cleaning sheet.

Moreover, the inventors found that when the perimeter of the fixing roller or the perimeter of the fixing belt was longer than the length of the typically-used electrophotographic image-receiving sheets in the direction of feeding, it was difficult to place a cleaning sheet (electrophotographic image-receiving sheet) onto the portion of at least one of the fixing roller and the fixing belt where cleaning was needed and therefore it was difficult to clean effectively.

A cleaning process of the present invention uses an image forming apparatus having at least a heating and pressuring means which fixes toner on an electrophotographic image-receiving sheet having a support and a toner image-receiving layer containing a thermoplastic resin over the support, and a cleaning sheet which removes stains adhered on the heating and pressuring means, wherein the heating and pressuring means is at least one of a fixing belt and a fixing roller, the electrophotographic image-receiving sheet is used as the cleaning sheet, and the cleaning sheet satisfies at least one of the following formulae: L1 (cm)>L2 (cm) and L1 (cm)>L3 (cm), wherein L1 represents the length of the cleaning sheet in the direction of feeding; L2 represents the perimeter of the fixing roller; and L3 represents the perimeter of the fixing belt. As a result, it is possible to ensure easy cleaning of at least one of the fixing roller and fixing belt of the electrophotographic apparatus.

An image forming apparatus of the present invention has at least a heating and pressuring means which fixes toner on an electrophotographic image-receiving sheet having a support and a toner image-receiving layer containing a thermoplastic resin over the support, and a cleaning sheet which removes stains adhered on the heating and pressuring means, wherein the heating and pressuring means is at least one of a fixing belt and a fixing roller, the same sheet for the electrophotographic image-receiving sheet is used as the cleaning sheet, and the cleaning sheet satisfies at least one of the following formulae: L1 (cm)>L2 (cm) and L1 (cm)>L3 (cm), wherein L1 represents the length of the cleaning sheet in the direction of feeding. As a result, it is possible to ensure easy cleaning of at least one of the fixing roller and fixing belt of the electrophotographic apparatus.

DESCRIPTION OF THE PREFERRED EMBODIMENTS

<Cleaning Process and Image Forming Apparatus>

A cleaning process of the present invention uses a cleaning sheet to remove stains adhered on the heating and pressuring means of an image forming apparatus which fixes toner on an electrophotographic image-receiving sheet which has a support and a toner image-receiving layer containing a thermoplastic resin on the support, wherein the electrophotographic image-receiving sheet is used as the cleaning sheet without any modification.

An image forming apparatus of the present invention is used for the cleaning process of the present invention.

The cleaning process of the present invention will be illustrated in detail hereafter, by which the detail of the image forming apparatus of the present invention will become apparent.

Figure 1:
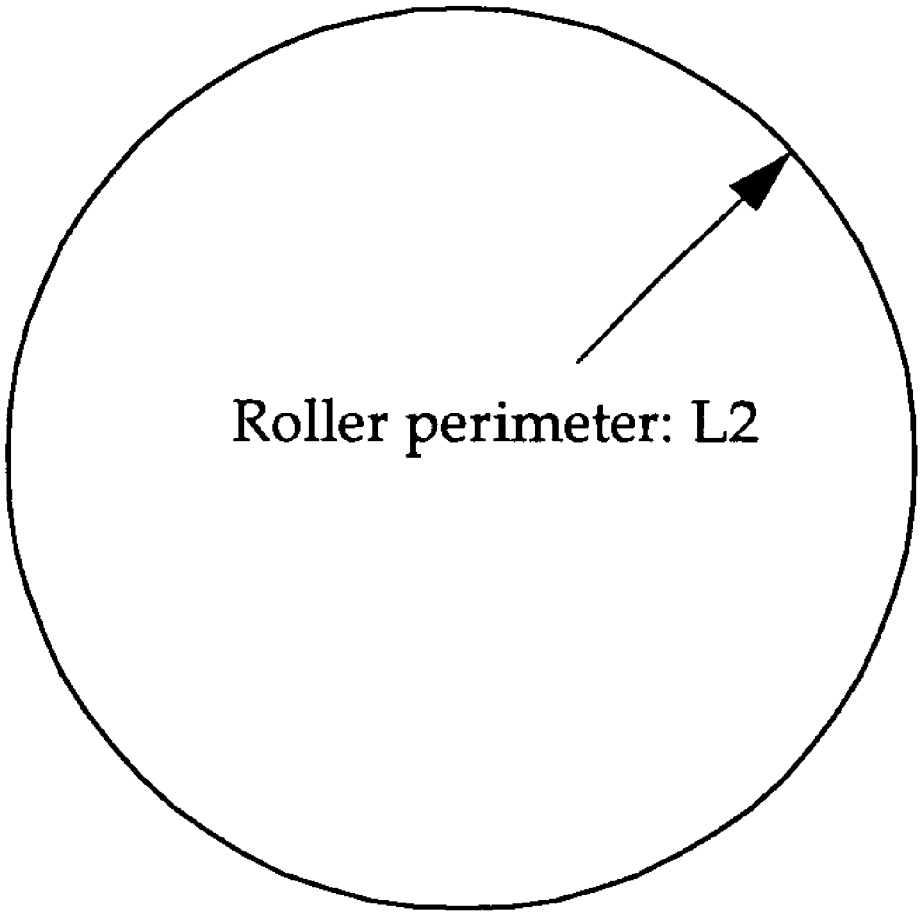
FIG. 1 is a view illustrating the perimeter of a fixing roller.
Figure 2:
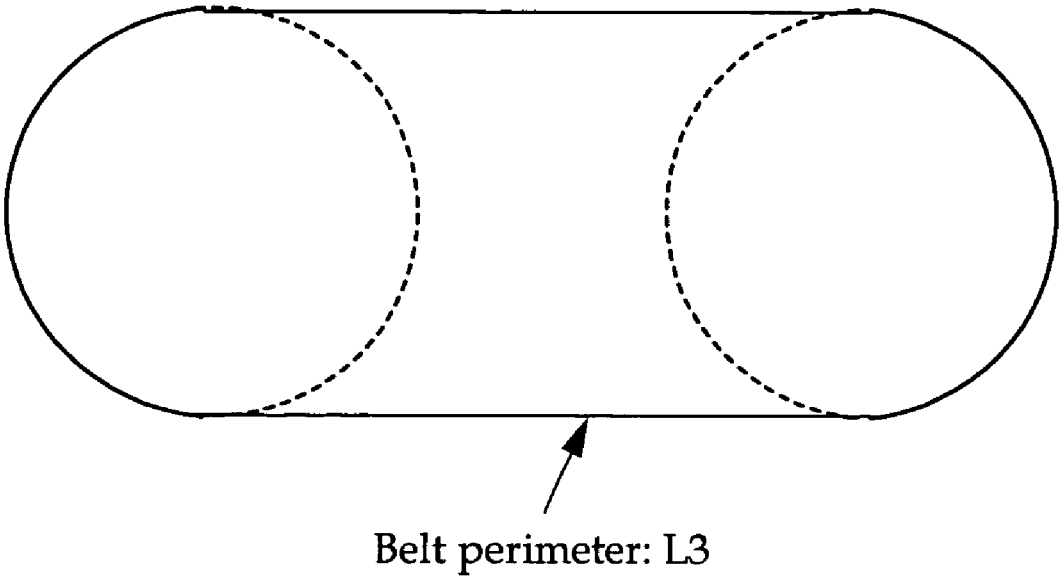
FIG. 2 is a view illustrating the perimeter of a fixing belt.
Figure 3:
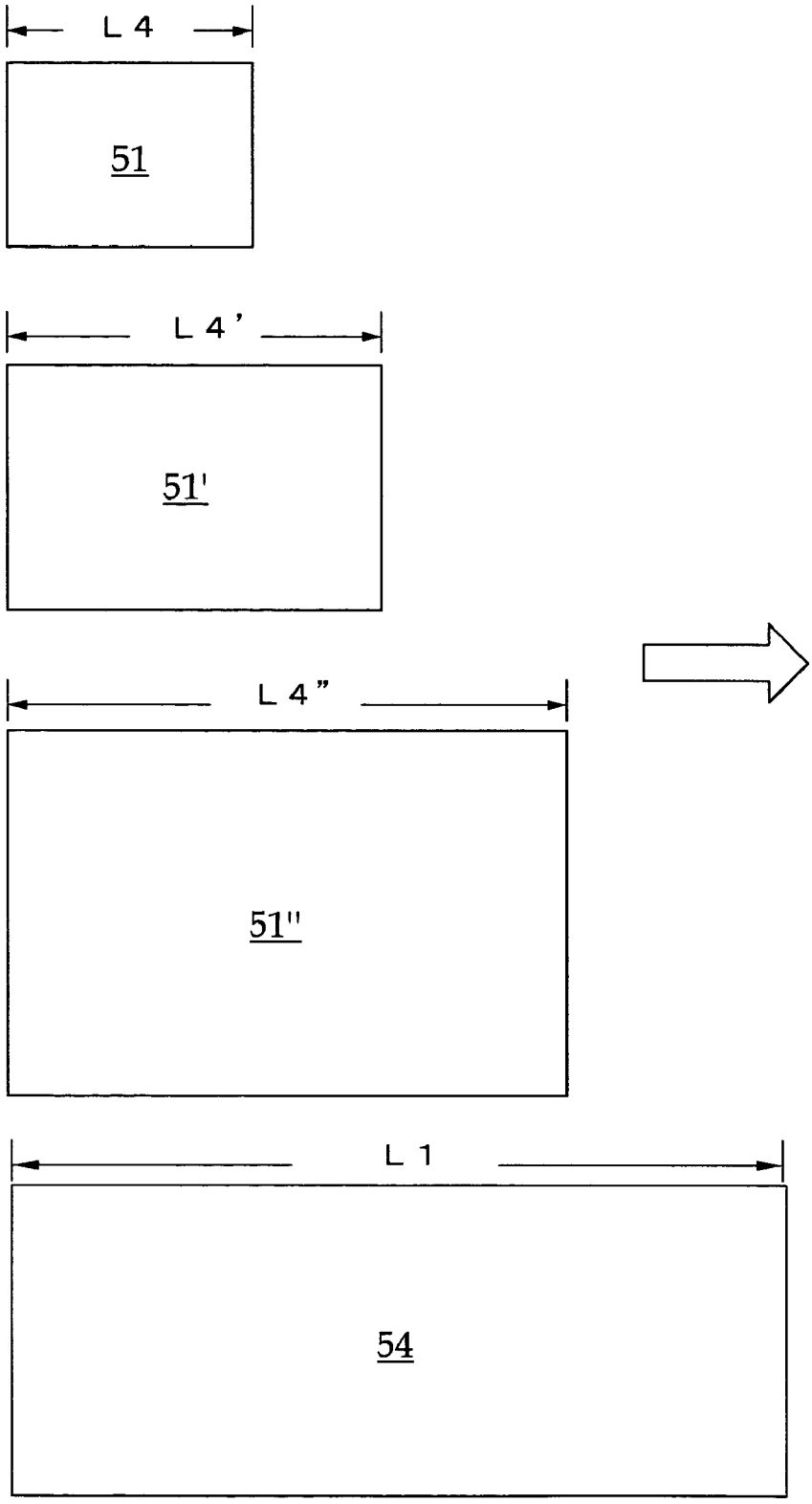
FIG. 3 is a view illustrating the lengths of various electrophotographic image-receiving sheets in the direction of feeding.

FIG. 1 is a schematic side view of a fixing roller. The circumference of the circle represented by a solid line is the perimeter of the fixing roller (L2). FIG. 2 is a side view of a fixing belt. The total length of the straight lines and arcs is the perimeter of the fixing belt (L3). FIG. 3 is a schematic view showing examples of electrophotographic image-receiving sheets and an example of a cleaning sheet. The electrophotographic image-receiving sheets 51, 51', and 51" for output (or for print) and the cleaning sheet 54 are transported in the direction indicated by the arrow. In such case, the length of the sheet in the direction of feeding is, for each sheet, L4, L4', L4", and L1, respectively.

The electrophotographic image-receiving sheet (cleaning sheet) which has a toner image-receiving layer containing a thermoplastic resin on a support, and the length of which in the direction of feeding (L1) is longer than at least one of the perimeter of the fixing roller (L2) and the perimeter of the fixing belt (L3), both of which are the heating and pressuring means, is used as a cleaning sheet. Accordingly, at least one of the following formulae are met: L1>L2 and L1>L3.

If the length of the cleaning sheet (electrophotographic image-receiving sheet) in the direction of feeding (L1) is shorter than the perimeter of the fixing roller (L2) and the perimeter of the fixing belt (L3), the area of the electrophotographic image-receiving sheet that is in contact with the fixing roller or the fixing belt becomes small and the efficiency of cleaning is reduced.

For example, it is preferable that the length of the cleaning sheet in the direction of feeding (L1) be longer than the perimeter of the fixing roller (L2) or the perimeter of the fixing belt (L3) by from 0.5 cm to 15 cm. It is particularly preferable that it be longer by from 1 cm to 12 cm.

Specifically, as shown in FIGS. 1 to 3, it is preferable that the length of the cleaning sheet in the direction of feeding (L1), the perimeter of the fixing roller (L2), the perimeter of the fixing belt (L3), and the length of the electrophotographic print sheet of the smallest size in the direction of feeding (L4) satisfy at least one of the two following formulae: L1>L2, L3 and L2, L3>L4, from the viewpoint that cleanability is enhanced because the entire perimeter of the heating and pressuring means may be cleaned in a single operation, or from the viewpoint of image quality.

There are various sizes for the electrophotographic print sheet, typically including L-size (89 mm×127 mm) print, A6-size (105 mm×150 mm) print, A4-size (210 mm×300 mm) print, B4-size, B5-size, postcard-size, business card-size, and the like, but here, the size of the smallest sheet for the image forming apparatus which is to be cleaned is defined as L4.

It is preferable that the electrophotographic image-receiving sheet be in the form of a roll, and there be a cutting means which cuts the electrophotographic image-receiving sheet in a predetermined size because the length of the electrophotographic image-receiving sheet in the direction of feeding may be adjusted according to the perimeter of the fixing roller (L2) or the perimeter of the fixing belt (L3) which are the heating and pressuring means, so as to create easily a cleaning sheet which can clean the entire perimeter of the heating and pressuring means in a single operation.

It is preferable that the fixing temperature at which toner is fixed on the electrophotographic image-receiving sheet and the temperature of the fixing portion during cleaning be different. For example, the temperature of the fixing portion during cleaning is preferably slightly lower than the fixing temperature from the viewpoint that it improves cleaning properties. Preferably, the fixing temperature is higher than the temperature of the fixing portion during cleaning by 1° C. or more.

It is preferable that the fixing transport speed at which toner is fixed on the electrophotographic image-receiving sheet and the transport speed at the fixing portion during cleaning be different. For example, the transport speed at the fixing portion during cleaning is preferably slightly lower than the transport speed during fixing from the viewpoint that it improves cleaning properties. Preferably, the transport speed during fixing is higher than the transport speed at the fixing portion during cleaning by 1 mm/sec or more.

The electrophotographic image-receiving sheet is not particularly limited, and can suitably be selected according to the purpose, provided that the sheet has a support and a toner image-receiving layer containing a thermoplastic resin on the support. The electrophotographic image-receiving sheet will be described in detail later in this specification.

<Image Forming Apparatus>

The image forming apparatus of the present invention is used for the cleaning process of the present invention, has at least a heating and pressuring means and a cleaning sheet, and has sheet containing means, sheet feeding means, sheet cutting means, and other means if necessary.

-Sheet Containing Means-

The sheet containing means is not particularly limited, and can suitably be selected from well known sheet containing means, provided that the means can be loaded with electrophotographic sheets having a toner image-receiving layer containing a thermoplastic resin on a support.

Examples of the containing means include sheet tray, magazine rack, and the like.

-Sheet Feeding Means-

The sheet feeding means is not particularly limited, and can suitable be selected from well known sheet feeding means, provided that the means can advance electrophotographic sheets.

Examples of the sheet feeding means include a method using a pickup roller and the like.

-Sheet Cutting Means-

The sheet cutting means is not particularly limited, and can suitably be selected from well known sheet cutting means, provided that the means can cut the electrophotographic image-receiving sheet in a predetermined size.

Examples of the sheet cutting means include circular cutter, guillotine cutter, rotary cutter, XY-oriented cutter, and the like.

-Heating and Pressuring Means-

The heating and pressuring means is not particularly limited, and can suitably be selected according to the purpose. Examples thereof include those which are used as fixing devices in well known electrophotographic apparatuses such as a pair of heating rollers, a combination of a pair of heating rollers and a belt, a belt-fixing smoothing device employing cooling separation, which will be described hereinafter, and the like.

Such pair of heating rollers is not particularly limited, and can suitably be selected according to the purpose. For example, it may suitably be selected from among pairs of heating rollers used in well known electrophotographic apparatuses or the like, and preferably from those which can adjust nip pressure, heating temperature, and the like.

The heating and pressuring means preferably performs heating and pressuring at a temperature which is equal to or higher than the softening point of the thermoplastic resin which constitutes the toner image-receiving layer. Specifically, for example, while it can suitably be selected according to the thermoplastic resin, it is typically from about 50° C. to about 120° C., preferably from 80° C. to 110° C. if the toner image-receiving layer of the electrophotographic image-receiving sheet contains a thermoplastic resin, and more preferably from 95° C. to 105° C. if the thermoplastic resin is polyethylene.

<Belt-fixing Smoothing Device>

The belt-fixing smoothing device comprises a fixing roller, a fixing belt, a cooling device, a cooling and separating unit, and other members if necessary.

Examples of the fixing roller include the pair of heating rollers described above, and the like.

The cooling device is not particularly limited. Examples thereof include a cooling device which can blow cool air and adjust cooling temperature, a heat sink, and the like.

The cooling and separating unit is not particularly limited, and it may suitably be selected according to the purpose. It typically has a spot near a tension roller where an electrophotographic image-receiving sheet separates from a belt by rigidity (elasticity) of the sheet itself.

The fixing belt in the belt fixing and smoothing device comprises a heat-resistant support film and a releasing layer arranged on the support film.

The support film is not specifically limited, as long as it has heat resistance, and is, for example, a film of a polyimide (PI), a poly(ethylene naphthalate) (PEN), a poly(ethylene terephthalate) (PET), a poly(ether ether ketone) (PEEK), a poly(ether sulfone) (PES), a poly(ether imide) (PEI), or a poly(parabanic acid) (PPA).

The releasing layer preferably comprises at least one of silicone rubbers, fluorocarbon rubbers, fluorocarbonsiloxane rubbers, silicone resins, and fluorocarbon resins. Of these, it is preferred to dispose a layer of fluorocarbon siloxane rubber on the surface of the fixing belt, or to dispose a layer of silicone rubber on the surface of the fixing belt, and then to dispose a layer of fluorocarbon siloxane rubber on the surface of the layer of silicone rubber.

It is preferred that the fluorocarbon siloxane rubber has at least one of a perfluoroalkyl ether group and a perfluoroalkyl group in a main chain thereof.

For the fluorocarbon siloxane rubber, a cured product of fluorocarbon siloxane rubber composition which contains components of (A) to (D) is preferable.

(A) a fluorocarbon polymer having a fluorocarbon siloxane expressed by the following General Formula 1 as its main component, and containing aliphatic unsaturated groups, (B) an organopolysiloxane and/or fluorocarbon siloxane containing two or more SiH groups in one molecule, and 1 to 4 times more the molar amount of SiH groups than the amount of aliphatic unsaturated groups in the fluorocarbon siloxane rubber, (C) a filler, and (D) an effective amount of catalyst; and the like.

The fluorocarbon polymer having (A) as a component comprises a fluorocarbon siloxane containing a repeated unit expressed by the following General Formula 1 as its main component, and contains aliphatic unsaturated groups.

General Formula (1)

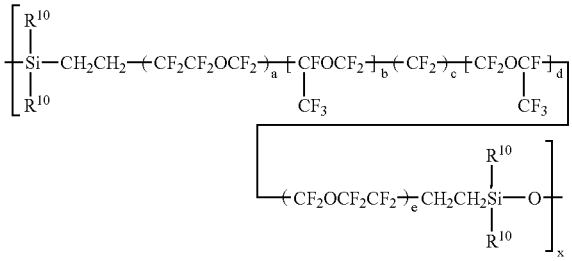

Herein, in the General Formula 1, $R^{10}$ is a non-substituted or substituted monofunctional hydrocarbon group containing 1 to 8 carbon atoms, preferably an alkyl group containing 1 to 8 carbon atoms or an alkenyl group containing 2 to 3 carbon atoms, and particularly preferably a methyl group.

"a" and "e" are, independent of the other, an integer of 0 or 1. "b" and "d" are independently an integer of 1 to 4. "c" is an integer of from 0 to 8. "x" is preferably 1 or greater, and more preferably from 10 to 30.

An example of this component (A) include a substance expressed by the following General Formula 2:

General Formula (2)

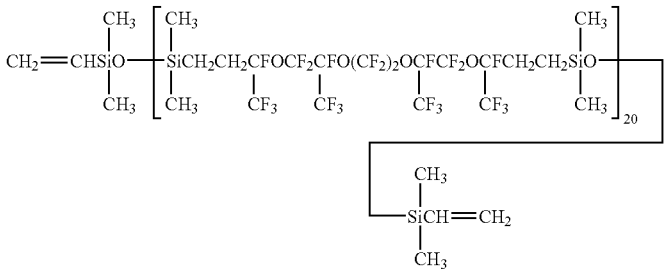

In Component (B), one example of the organopolysiloxane comprising SiH groups is an organohydrogenpolysiloxane having at least two hydrogen atoms bonded to silicon atoms in the molecule.

In the fluorocarbon siloxane rubber composition, when the organocarbon polymer of Component (A) comprises an aliphatic unsaturated group, the organohydrogenpolysiloxane is preferably used as a curing agent. That is, the cured product is formed by an addition reaction between aliphatic unsaturated groups in the fluorocarbon siloxane, and hydrogen atoms bonded to silicon atoms in the organohydrogenpolysiloxane.

Examples of these organohydrogenpolysiloxanes include the various organohydrogenpolysiloxanes used in an addition-curing silicone rubber composition.

It is generally preferred that the organohydrogenpolysiloxane is blended in such a proportion that the number of "SiH groups" therein is at least one, and particularly 1 to 5, relative to one aliphatic unsaturated hydrocarbon group in the fluorocarbon siloxane of Component (A).

It is preferred that in the fluorocarbon containing SiH groups, one unit of the General Formula 1 or $R^{10}$ in the General Formula 1 is a dialkylhydrogensiloxane group, the terminal group is an SiH group such as a dialkylhydrogensiloxane group, a silyl group, or the like. An example of the fluorocarbon includes those expressed by the following General Formula 3.

General Formula (3)

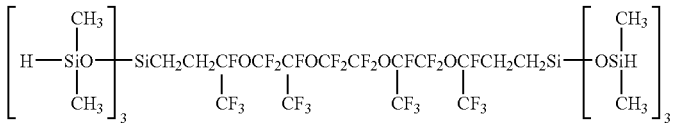

The filler, which is Component (C), may be various fillers used in ordinary silicone rubber compositions. Examples of the filler include reinforcing fillers such as mist silica, precipitated silica, carbon powder, titanium dioxide, aluminum oxide, quartz powder, talc, sericite, bentonite, or the like; fiber fillers such as asbestos, glass fiber, organic fibers or the like.

Examples of the catalyst, which is Component (D), include those any known as an addition reaction catalyst in the art. Specific examples of the catalyst include chloroplatinic acid, alcohol-modified chloroplatinic acid, complexes of chloroplatinic acid and olefins, platinum black or palladium supported on a carrier such as alumina, silica, carbon, or the like, and Group VIII elements of the Periodic Table or compounds thereof such as complexes of rhodium and olefins, chlorotris(triphenylphosphine) rhodium (an Wilkinson catalyst), rhodium (III) acetyl acetonate, or the like. It is preferred to dissolve these complexes in an alcohol solvent, an ether solvent, a hydrocarbon solvent, or the like.

The fluorocarbon siloxane rubber composition is not particularly limited, and it may suitably be selected according to the purpose and may include various additives. For example, dispersing agents such as diphenylsilane diol, low polymer chain end hydroxyl group-blocked dimethylpolysiloxane, hexamethyl disilazane, heat resistance improvers such as ferrous oxide, ferric oxide, cerium oxide, octyl acid iron, or the like; and colorants such as pigments or the like, may be added as a compounding agent, if necessary.

The fixing belt is obtained by coating the surface of a heat resistant support film with the fluorocarbon siloxane rubber composition, and heat and cure it. The composition may be diluted to form a coating solution with a solvent such as m-xylene hexafluoride, benzotrifluoride, or the like. The heat curing temperature and time can be suitably selected. The heat curing temperature and time can be suitably selected within the ranges of 100° C. to 500° C. and 5 seconds to 5 hours, according to a type of the support film, a process for manufacturing thereof, or the like.

A thickness of the releasing layer formed on the surface of the fixing belt is not particularly limited. The thickness is preferably 1 μm to 200 μm, and more preferably 5 μm to 150 μm, so as to obtain good fixing properties for an image, with preventing toner separation and offset of the toner at the same time.

The belt fixing method may for example be the oilless apparatus for electrophotography as described in JP-A No. 11-352819, or the method where a secondary transfer and fixing are realized simultaneously as described in JP-A Nos. 11-231671 and 05-341666. An apparatus for electrophotography having a fixing belt according to the present invention may be an apparatus for electrophotography including for example at least a heating and pressurizing part which can melt and pressurize the toner, a fixing belt which can transport an image-receiving material with adhering toner while in contact with the toner image-receiving layer, and a cooling part which can cool the heated image-receiving material while it is still adhering to the fixing belt. By using the electrophotographic image-receiving sheet having the toner image-receiving layer in the apparatus for electrophotography which includes the fixing belt, toner adhering to the toner image-receiving layer is fixed in fine detail without spreading onto the image-receiving material, and the molten toner is cooled and solidified, while adhering closely to the fixing belt. In this way, the toner is received onto the electrophotographic image-receiving sheet with completely embedded in the toner image-receiving layer. Therefore, there are no image discrepancies, and a glossy and smooth toner image is obtained.

The fixing is an important step that influences the glossiness and the smoothness of the toner image in a final state. The fixing method may be carried out by a heating and pressurizing roller, or belt fixing using a belt, but from the viewpoint of image quality such as gloss and smoothness, belt fixing is preferred. Belt fixing methods known in the art include for example an oil-less belt fixing described in JP-A No. 11-352819, and the method where secondary transfer and fixing are realized simultaneously as described in JP-A Nos. 11-231671 and 05-341666. Further, a primary fixing may also be performed by a heat roller before the heating and pressurizing by the fixing belt and fixing roller.

Figure 4:
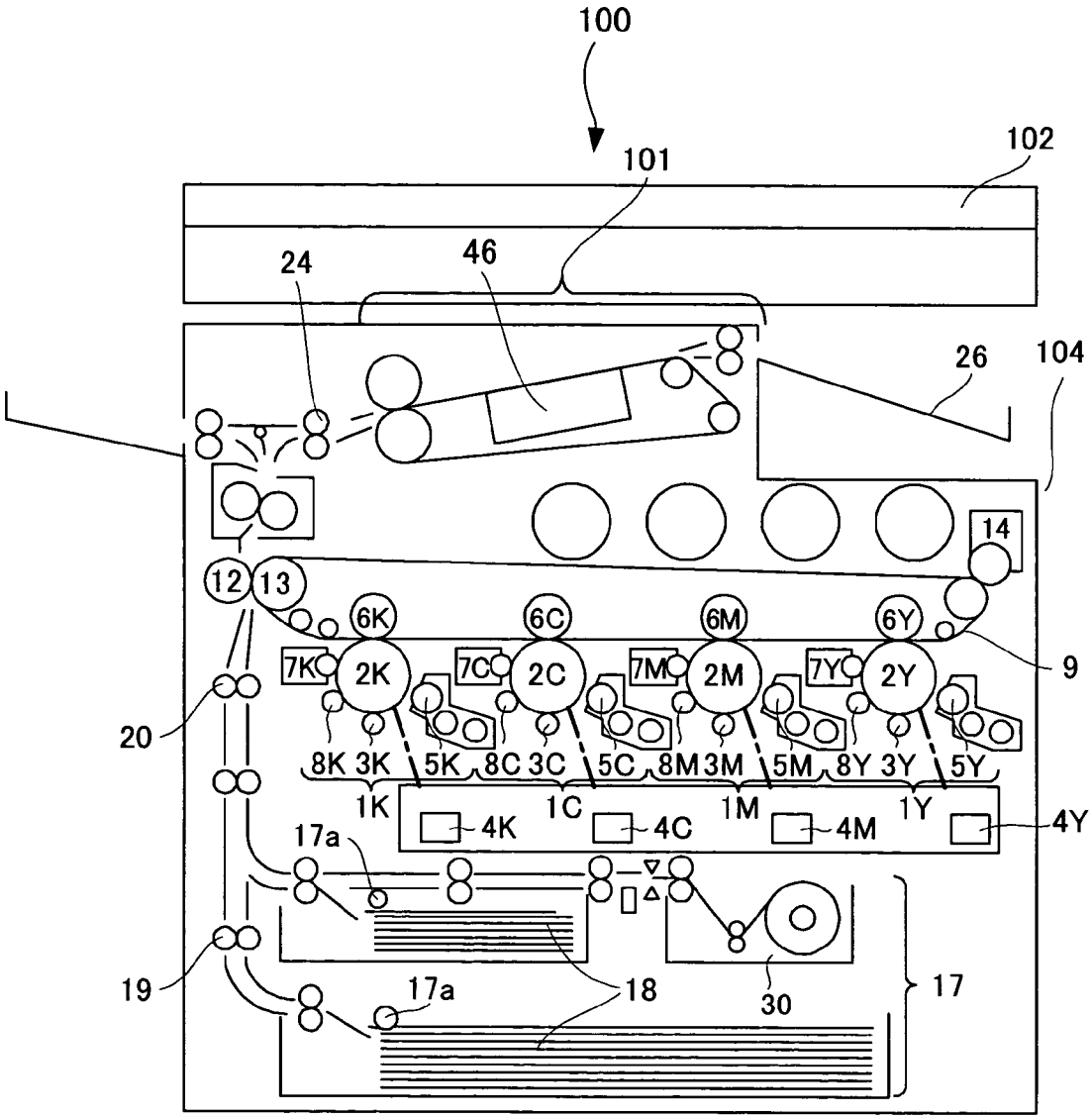
FIG. 4 is a schematic view of an example of an electrophotographic apparatus for use in the present invention.

FIG. 4 is a schematic configuration view showing an example of a color copying machine (image forming apparatus) 100 of the present invention. The color copying machine 100 comprises a main body 104 and an image reader (document read means) 102. The main body 104 houses an image output section (image-forming section) and a belt image-fixing device 101.

The image forming section comprises an endless intermediate image transfer belt 9 which is spanned over plural tension rollers and is rotated, electrophotographic image forming units 1Y, 1M, 1C, and 1K, a belt cleaner 14 facing the intermediate image transfer belt 9, a secondary image transfer roller 12 facing the intermediate image transfer belt 9, sheet tray 17 for housing sheets of plain paper (electrophotographic image-receiving sheet) 18(S) and sheets of dedicated glossy paper (electrophotographic image-receiving sheet) 18(P), respectively, a pickup roller 17*a*, a pair of conveyer rollers 19 and 24, a pair of resist rollers 20, and a second paper output tray 26. The electrophotographic image forming units 1Y, 1M, 1C, and 1K are arranged from upstream to downstream of a rotation direction of the intermediate image transfer belt 9 and serve to form yellow, magenta, cyan, and black color toner images, respectively. In addition, it has a roll paper unit 30 which holds a roll of a sheet. The roll paper unit 30 includes a sheet containing means, a sheet feeding means, and a sheet cutting means.

Each of the electrophotographic image forming units 1Y, 1M, 1C, and 1K comprises, for example, a photoconductive drum (2Y, 2M, 2C, and 2K, respectively), an electrostatic charger roller (3Y, 3M, 3C, and 3K, respectively), a development device (5Y, 5M, 5C, and 5K, respectively), a primary image transfer roller (6Y, 6M, 6C, and 6K, respectively), a drum cleaner (7Y, 7M, 7C, and 7K, respectively), and a charge eliminating roller (8Y, 8M, 8C, and 8K, respectively).

Figure 5:
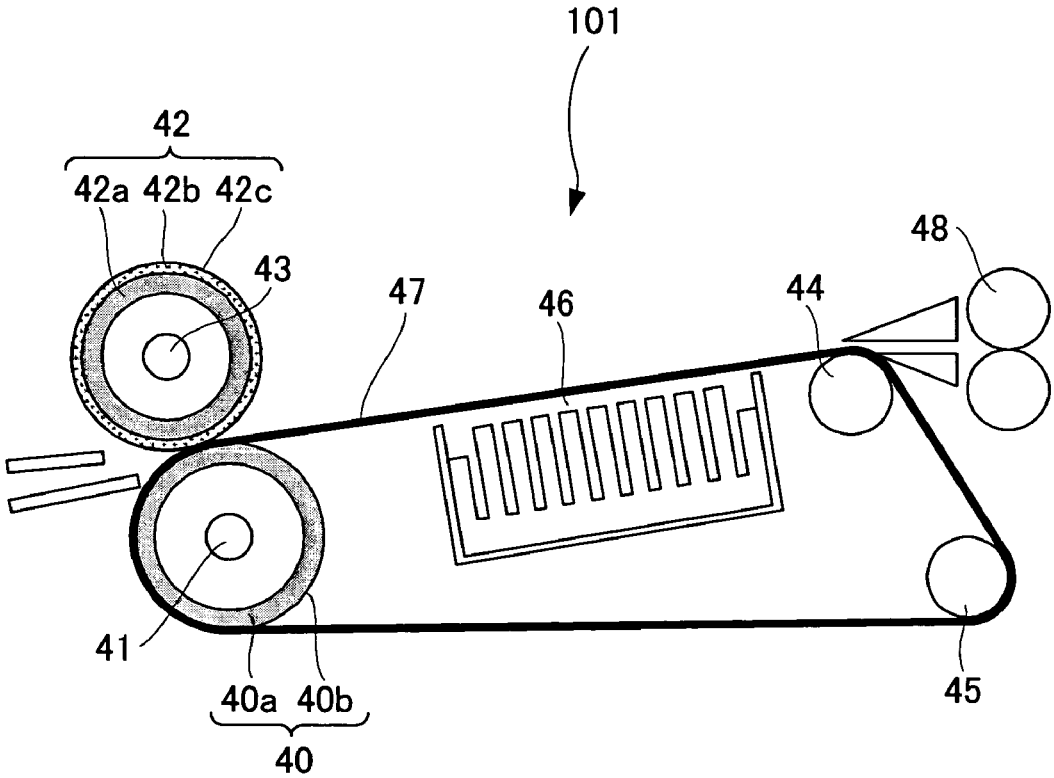
FIG. 5 is a schematic view showing an example of a belt-fixing smoothing device employing cooling separation according to the present invention.

FIG. 5 illustrates a configuration of the belt image-fixing device 101. The image-fixing device 101 is a belt fixing device which comprises a heating and fixing roller (heating roller) 40 having a heat source, a releasing roller (tension roller) 44, a steering roller (tension roller) 45, a fixing belt (endless belt) 47, a pressure roller 42, and a cooling device (cooling unit) 46. The fixing belt 47 is spanned among the heating and fixing roller 40, the releasing roller 44, and the steering roller 45. The pressure roller 42 serves to press the heating and fixing roller 40 via the fixing belt 47 to thereby form a nip. The cooling device (cooling unit) 46 is arranged downstream the nip of the rotation direction of the fixing belt 47 and serves to cool the fixing belt 47. An electrophotographic image-receiving sheet 18 bearing a toner is conveyed to the nip so as to bring the toner image into contact with the fixing belt 47, and the toner image is heated and fixed therein. The cooling device 46 then cools the fixing belt 47 and the electrophotographic image-receiving sheet 18, and the electrophotographic image-receiving sheet 18 is released (peeled off) from the fixing belt 47.

The heating and fixing roller 40 comprises a core 40*a* and a releasing layer 40*b* arranged on the surface of the core 40*a*. The core 40*a* is made of a metal having high thermal conductivity. The releasing layer 40*b* is made of a fluorocarbon resin layer such as a PFA tube. A heat source 41 such as a halogen lamp is arranged inside the core 40*a* and serves to heat the heating and fixing roller 40 to a predetermined surface temperature to thereby heat the fixing belt 47 and the image-receiving sheet 18 bearing the toner image. The pressure roller 42 comprises a core 42*a*, an elastic layer 42*b* arranged around the core 42*a*, and a releasing layer 42*c* arranged on the surface of the elastic layer 42*b*. The core 42*a* is made of a metal having high thermal conductivity. The elastic layer 42*b* is made of, for example, a silicone rubber having a rubber hardness (JIS-A) of about 40 degrees. The releasing layer 42*c* is a fluorocarbon resin layer such as a PFA tube. A heat source 43 such as a halogen lamp is arranged inside the core 42*a* and serves to heat the pressure roller 42 to a predetermined surface temperature. The pressure roller 42 thus serves to apply pressure to the electrophotographic image-receiving sheet 18 during image-fixing procedure and to heat the electrophotographic image-receiving sheet 18 from its back side. The configurations of the heating and fixing roller 40 and the pressure roller 42 are not limited to those mentioned above, as long as a toner image formed on the electrophotographic image-receiving sheet 18 can be fixed to the electrophotographic image-receiving sheet 18 by the aid of the fixing belt 47.

The releasing roller 44 serves to remove the electrophotographic image-receiving sheet 18 from the fixing belt 47 by action of the rigidity of the electrophotographic image-receiving sheet 18 itself. The outer shape (outer dimensions) of the releasing roller 44 is determined depending on the adhesion between the fixing belt 47 and the electrophotographic image-receiving sheet 18, and the winding angle of the fixing belt 47 to the releasing roller 44. The steering roller 45 serves to correct and regulate any wandering of the fixing belt 47 caused by rotation of the fixing belt 47 and to avoid damage of the edge of the belt due to wandering. This steering roller 45 is supported at one axial end thereof and can be tilted to a desired angle with respect to the heating and fixing roller 40. Thus, is the fixing belt 47 wanders, the steering roller serves to change the direction of the belt travel to an opposite direction.

The cooling device 46 serves to cool the fixing belt 47 and the image-receiving sheet 18 in intimate contact with the fixing belt 47 and is arranged on an inner radius of the fixing belt 47 downstream from the heating and fixing roller 40 and upstream from the releasing roller 44. The cooling device 46 is capable of cooling a transparent resin layer 18*a* and the toner image on the surface of the image-receiving sheet 18 fused by action of the heating and fixing roller 40 and the pressure roller 42 and of solidifying the entire surface of the image smoothly along the surface of the fixing belt 47.

The fixing belt 47 can be prepared, for example, in the following manner. A silicone rubber primer DY39-115 (trade name, available from Dow Corning Toray Silicone Co., Ltd., Japan) is applied to an endless film made of a thermosetting polyimide and is air-dried for 30 minutes. The resulting article is dipped in a coating liquid comprising 100 parts by mass of a silicone rubber precursor DY35-796AB (trade name, available from Dow Corning Toray Silicone Co., Ltd., Japan) and 30 parts by mass of n-hexane to thereby form a coated film, is subjected to primary curing at 120° C. for 10 minutes and thereby yields a silicone rubber layer 40 μm thick thereon.

The silicone rubber layer is then dipped in a coating liquid comprising 100 parts by mass of a fluorocarbon siloxane rubber precursor SIFEL 610 (trade name, available from Shin-Etsu Chemical Co., Ltd., Japan) and 20 parts by mass of a fluorine-containing solvent (a mixture of m-xylene hexafluoride, perfluoroalkanes, and perfluoro(2-butyltetrahydrofuran)) to form a coated film, is subjected to primary curing at 120° C. for 10 minutes and to secondary curing at 180° C. for 4 hours to yield a fluorocarbon siloxane rubber layer 20 μm thick thereon and thereby yields the fixing belt.

The image-fixing device 101 is arranged below the image reader 102 and above the image forming section (e.g., at image transfer position). The image-fixing device 101 is positioned directly above the image forming section (e.g., the intermediate image transfer belt 9) and directly under the image reader 102. The entire conveying path for the electrophotographic image-receiving sheet 18 extending from the second image transfer position to the image-fixing device 101 is positioned directly above the image forming section (e.g., the intermediate image transfer belt 9). A primary image-fixing line connecting between the secondary image transfer position and the primary image transfer position has a substantially normal vertical component. An image-fixing line connecting between the secondary image transfer position and the image-fixing position has a vertical component less than a horizontal component thereof. The image-receiving sheet 18 is ejected from the image-fixing device 101 to an area directly above the image forming section (e.g., the intermediate image transfer belt 9).

<Electrophotographic Image-receiving Sheet>

The electrophotographic image-receiving sheet of the present invention comprises a support and a toner image-receiving layer containing a thermoplastic resin which is to be disposed on at least one surface of this support. The electrophotographic image-receiving sheet may also comprise other layers which may be suitably selected if necessary. Examples of the other layers include a protection layer, an intermediate layer, an underlayer, a cushion layer, a static control (prevention) layer, a reflection layer, a color tone adjusting layer, a storage property improvement layer, an antistick layer, an anticurl layer, a smoothing layer, and the like. These layers may have a single-layer structure or a laminated structure.

[Support]

Examples of the support include paper, synthetic paper, synthetic resin sheet, resin-coated paper, resin-laminated paper, and the like. These supports may have a single layer, or have a laminated structure of two or more layers.

-Raw Paper-

The raw paper may be a high quality paper, for example, the paper described in *Basic Photography Engineering—Silver Halide Photography*, CORONA PUBLISHING CO., LTD. (1979) pp. 223–240, edited by the Institute of Photography of Japan.

The materials of the raw paper are not particularly limited, and can suitably be selected from various kinds of materials according to the purpose, provided that they are well known materials for electrophotographic image-receiving sheets. Examples of the materials of the raw paper include natural pulp selected from needle-leaf trees and broadleaf trees, synthetic pulp made from plastics materials such as polyethylene, polypropylene, or the like, a mixture of the natural pulp and the synthetic pulp, and the like.

Regarding pulps used as materials for the raw paper, from the viewpoint of good balance between surface flatness and smoothness of the raw paper, rigidity and dimensional stability (curl), broadleaf tree bleached kraft pulp (LBKP) is preferred. Needle-leaf bleached kraft pulp (NBKP), broadleaf tree sulfite pulp (LBSP), or the like can also be used.

A beater or a refiner, or the like, can be used for beating the pulp.

Canadian standard freeness of the pulp is preferably 200 ml C.S.F to 440 ml C.S.F, and more preferably 250 ml C.S.F to 380 ml C.S.F, from the viewpoint of controlling contraction of paper at a paper-manufacturing step.

Various additives, for example, fillers, dry paper reinforcers, sizing agents, wet paper reinforcers, fixing agents, pH regulators or other agents, or the like may be added, if necessary, to the pulp slurry (hereafter, may be referred to as pulp paper material) which is obtained after beating the pulp.

Examples of the fillers include calcium carbonate, clay, kaolin, white clay, talc, titanium oxide, diatomaceous earth, barium sulfate, aluminum hydroxide, magnesium hydroxide, and the like.

Examples of the dry paper reinforcers include cationic starch, cationic polyacrylamide, anionic polyacrylamide, amphoteric polyacrylamide, carboxy-modified polyvinyl alcohol, and the like.

Examples of the sizing agents include rosin derivatives such as aliphatic salts, rosin, maleic rosin or the like; paraffin wax, alkyl ketene dimer, alkenyl succinic anhydride (ASA), epoxy aliphatic amide, and the like.

Examples of the wet paper reinforcers include polyamine polyamide epichlorohydrin, melamine resin, urea resin, epoxy polyamide resin, and the like.

Examples of the fixing agents include polyfunctional metal salts such as aluminum sulfate, aluminum chloride, or the like; cationic polymers such as cationic starch, or the like.

Examples of the pH regulators include caustic soda, sodium carbonate, and the like.

Examples of other agents include defoaming agents, dyes, slime control agents, fluorescent whitening agents, and the like.

Moreover, softeners can also be added if necessary. For the softeners, ones which are disclosed on pp. 554–555 of *Paper and Paper Treatment Manual* (Shiyaku Time Co., Ltd.) (1980) and the like can be used, for example.

Treatment liquids used for sizing a surface is not particularly limited, and can suitably be selected according to the purpose. They may contain, for example, water-soluble macromolecular compound, waterproof materials, pigments, dyes, fluorescent whitening agents, and the like.

Examples of the water-soluble macromolecular compounds include cationic starch, polyvinyl alcohol, carboxy-modified polyvinyl alcohol, carboxymethylcellulose, hydroxyethylcellulose, cellulose sulfite, gelatin, casein, sodium polyacrylate, styrene-maleic anhydride copolymer sodium salt, sodium polystyrene sulfonate, and the like.

Examples of the waterproof materials include latex emulsions such as styrene-butadiene copolymer, ethylene-vinyl acetate copolymer, polyethylene, vinylidene chloride copolymer or the like; polyamide polyamine epichlorohydrin, and the like.

Examples of the pigments include calcium carbonate, clay, kaolin, talc, barium sulfate, titanium oxide, and the like.

As for the above-mentioned raw paper, to improve the rigidity and dimensional stability (curl), it is preferred that the ratio (Ea/Eb) of the longitudinal Young's modulus (Ea) and the lateral Young's modulus (Eb) is within the range of 1.5 to 2.0. If the ratio (Ea/Eb) is less than 1.5 or more than 2.0, the rigidity and curl of the recording material tend to deteriorate, and may interfere with paper when transported.

It has been found that, in general, the "tone" of the paper differs based on differences in the way the paper is beaten, and the elasticity (modulus) of paper from paper-making after beating can be used as an important indication of the "tone" of the paper. The elastic modulus of the paper can be calculated from the following equation by using the relation of the density and the dynamic modulus which shows the physical properties of a viscoelastic object, and by measuring the velocity of sound propagation in the paper using an ultrasonic oscillator.

$$E=\rho c^2(1-n^2)$$

where "E" represents dynamic modulus; "ρ" represents density; "c" represents the velocity of sound in paper; and "n" represents Poisson's ratio.

As n=0.2 or so in a case of ordinary paper, there is not much difference in the calculation, even if the calculation is performed by the following equation:

$$E=\rho c^2$$

Accordingly, if the density of the paper and acoustic velocity can be measured, the elastic modulus can easily be calculated. In the above equation, when measuring acoustic velocity, various instruments known in the art may be used, such as a Sonic Tester SST-110 (Nomura Shoji Co., Ltd.) or the like.

In the raw paper, it is preferred to use pulp fibers having a fiber length distribution as disclosed, for example, in Japanese Patent Application Laid-Open (JP-A) No. 58-68037 (for example, the sum of 24-mesh screen residue and 42-mesh screen residue is 20% by mass to 45% by mass, and 24-mesh screen residue is 5% by mass or less) in order to give the desired center line average roughness to the surface. Moreover, the center line average roughness can be adjusted by heating and giving a pressure to a surface of the raw paper, with a machine calender, super calender, or the like.

The thickness of the raw paper is not particularly limited, and can suitably be selected according to the purpose, and it is preferably 50 μm to 300 μm, and more preferably 100 μm to 250 μm. The basis weight of the raw paper is not particularly limited, and can suitably be selected according to the purpose, and for example, it is preferably from 50 $g/m^2$ to 250 $g/m^2$, and more preferably from 100 $g/m^2$ to 200 $g/m^2$.

-Synthetic Paper-

Synthetic paper is a counterpart of paper the main component of which is polymer fibers other than cellulose. Examples of the polymer fibers include polyolefin fibers such as polyethylene, polypropylene, and the like.

-Synthetic Resin Sheet (Film)-

The synthetic resin sheet may be a synthetic resin formed in the shape of a sheet (film). Examples thereof include polypropylene films, drawn polyethylene films, drawn polypropylene, polyester films, drawn polyester films, nylon films, films made white by drawing, white films containing a white pigment, and the like.

-Coated Paper-

The coated paper is the paper one surface or both surfaces of which is coated with rubber latex, polymer materials, or the like. The amount to be coated differs according to the use. Examples of the coated paper include art paper, cast coated paper, Yankee paper, and the like.

If a resin is used to coat the surface of the raw paper or the like, for example, it is appropriate to use a thermoplastic resin. Examples of the thermoplastic resins include at least one the thermoplastic resins of the following (1) to (8).

(1) Polyolefin resins such as polyethylene resin and polypropylene resin, copolymer resins of olefins such as ethylene and propylene with other vinyl monomers, and acrylic resins, and the like.

(2) Thermoplastic resins containing at least an ester bond. For example, polyester resins obtained by condensation of dicarboxylic acid components (these dicarboxylic acid components may be substituted by a sulfonic acid group, a carboxyl group, and the like.) and alcoholic components (these alcoholic components may be substituted by the hydroxyl group, and the like), polyacrylic acid ester resins or polymethacrylic acid ester resins such as polymethylmethacrylate, polybutylmethacrylate, polymethylacrylate, polybutylacrylate, and the like; polycarbonate resin, polyvinyl acetate resin, styrene acrylate resin, styrene-methacrylic acid ester copolymer resin, vinyltoluene acrylate resin, and the like.

Specifically, the resins described in JP-A Nos. 59-101395, 63-7971, 63-7972, 63-7973, 60-294862, or the like may be mentioned.

Examples of commercial products include Bailon 290, Bailon 200, Bailon 280, Bailon 300, Bailon 103, Bailon GK-140 and Bailon GK-130 from Toyobo Co., Ltd; Tufton NE-382, Tufton U-5, ATR-2009 and ATR-2010 from Kao Corporation; Eritel UE3500, UE3210, XA-8153, KZA-7049 and KZA-1449 from Unitika Ltd.; polyester-TP-220 and R-188 from The Nippon Synthetic Chemical Industry Co., Ltd.; and thermoplastic resins in the high loss series from SEIKO CHEMICAL INDUSTRIES CO., LTD., and the like.

(3) Polyurethane resins, and the like.

(4) Polyamide resin, urea resin, and the like.

(5) Polysulfone resins, and the like.

(6) Polyvinyl chloride resin, polyvinylidene chloride resin, vinyl chloride-vinyl acetate copolymer resin, vinyl chloride-vinyl propionate copolymer resin, and the like.

(7) Polyol resins such as polyvinyl butyral, and cellulose resins such as ethyl cellulose resin and cellulose acetate resin.

(8) Polycaprolactone resin, styrene-maleic anhydride resin, polyacrylonitrile resin, polyether resin, epoxy resin, phenol resin, and the like.

One of the thermoplastic resins may be used either alone or in combination of two or more.

The thermoplastic resin may contain a fluorescent whitener; conductive agent; filler; pigment or dye including, for example, titanium oxide, ultramarine blue, and carbon black; or the like if necessary.

-Laminated Paper-

The laminated paper is the paper which is formed by laminating various kinds of resin, rubber, polymer sheets or films on raw paper or the like. Examples of the laminating materials include polyolefin, polyvinyl chloride, polyethylene terephthalate, polystyrene, polymethacrylate, polycarbonate, polyimide, triacetyl cellulose, and the like. These resins may be used alone, or in combination of two or more.

Polyolefin is generally formed using low-density polyethylene, but in order to improve heat resistance of the support, it is preferable to use polypropylene, a blend of polypropylene and polyethylene, high-density polyethylene, a blend of high-density polyethylene and low-density polyethylene, or the like. Particularly, from the viewpoint of cost, laminate applicability, and the like, it is most preferable to use a blend of high-density polyethylene and low-density polyethylene.

For the blend of high-density polyethylene and low-density polyethylene, its blending ratio (mass ratio) ranges, for example, from 1:9 to 9:1. The blending ratio is preferably from 2:8 to 8:2, and more preferably from 3:7 to 7:3. When thermoplastic layers are formed on both sides of the support, the back side of the support is preferably formed using, for example, high-density polyethylene or a blend of high-density polyethylene and low-density polyethylene. The molecular weights of the high-density polyethylene and low-density polyethylene are not particularly limited, but it is preferable that melt indices of both high-density polyethylene and low-density polyethylene be from 1.0 g/10-min to 40 g/10-min and that the polyethylenes be suitable for extrusion.

A sheet or film of these may receive a treatment to obtain reflectivity of white color. Examples of the treatment include mixing a pigment such as titanium oxide or the like in the sheet or film.

The thickness of the support is preferably 25 μm to 300 μm, more preferably 50 μm to 260 μm, and still more preferably 75 μm to 220 μm. The rigidity of the support may vary according to the purpose. It is preferred that the support used for the electrophotographic image-receiving sheet which gives photographic image quality be close to those used for color silver halide photography.

[Toner Image-receiving Layer]

The above-mentioned toner image-receiving layer receives color and/or black toners and forms an image. The toner image-receiving layer has a function to receive toner which forms an image from a developing drum or an intermediate transfer by (static) electricity or pressure in a transferring step, and to fix the image by heat or pressure in a fixing step. The toner image-receiving layer contains a thermoplastic resin as a main component, and further contains a release agent and other components.

In such case, a toner image-receiving layer containing a thermoplastic resin is preferably formed on at least one side of the support. Preferably, the thickness of the toner image-receiving layer is 3 μm or more, and more preferably 4 μm or more. These will reduce occurrence of curling or cracks under environmental changes and give photographic quality with gloss.

-Thermoplastic Resin-

The thermoplastic resin is not particularly limited, and it may suitably be selected according to the purpose, provided that it is deformable under certain temperatures, for example during fixing, and that it accepts toner. However, a resin similar to the binder resin of a toner is preferable. Many toners employ a polyester resin or a copolymer resin such as styrene-butylacrylate, and in such case, the thermoplastic resin used for the electrophotographic image-receiving sheet preferably contains a polyester resin or a copolymer resin such as styrene-butylacrylate, more preferably 20% by mass or more of a polyester resin or a copolymer resin such as styrene-butylacrylate. Also preferable are styrene-acrylate copolymers, styrene-methacrylate copolymers, and the like.

Specific examples of the thermoplastic resins are (i) resins each having an ester bond, (ii) polyurethane resins and similar resins, (iii) polyamide resins and similar resins, (iv) polysulfone resins and similar resins, (v) poly(vinyl chloride) resins and similar resins, (vi) poly(vinyl butyral) and similar resins, (vii) polycaprolactone resins and similar resins, and (viii) polyolefin resins and similar resins.

The resins containing one or more ester bonds (i) include, for example, polyester resins obtained by condensation of a dicarboxylic acid component and an alcoholic component, polyacrylate resins or polymethacrylate resins such as polymethylmethacrylate, polybutylmethacrylate, polymethylacrylate, polybutyl acrylate, or the like; polycarbonate resins, polyvinyl acetate resins, styrene acrylate resins, styrene-methacrylate copolymer resins, vinyltoluene acrylate resins, or the like. Specific examples of the dicarboxylic acid component include terephthalic acid, isophthalic acid, maleic acid, fumaric acid, phthalic acid, adipic acid, sebacic acid, azelaic acid, abietic acid, succinic acid, trimellitic acid, pyromellitic acid, and the like. More preferably, the thermoplastic resin alone satisfies the preferable physical properties. Specific examples of the alcoholic component include ethylene glycol, diethylene glycol, propylene glycol, bisphenol A, diether derivative of bisphenol A (for example, ethylene oxide diadduct of bisphenol A, propylene oxide diadduct of bisphenol A) or bisphenol S, 2-ethyl cyclohexyldimethanol, neopentyl glycol, dicyclohexyldimethanol or glycerol. These may be substituted by hydroxyl groups.

Examples can also be found in JP-A Nos. 59-101395, 63-7971, 63-7972, 63-7973 and 60-294862.

Examples of commercial products of the polyester resins include Bailon 290, Bailon 200, Bailon 280, Bailon 300, Bailon 103, Bailon GK-140 and Bailon GK-130 from Toyobo Co., Ltd; Tufton NE-382, Tufton U-5, ATR-2009 and ATR-2010 from Kao Corporation; Eritel UE3500, UE3210, XA-8153 from Unitika Ltd.; Polyester TP-220 and R-188 from The Nippon Synthetic Chemical Industry Co., Ltd., and the like.

Examples of commercial products of the above-mentioned acrylic resins include SE-5437, SE-5102, SE-5377, SE-5649, SE-5466, SE-5482, HR-169, HR-124, HR-1127, HR-116, HR-113, HR-148, HR-131, HR-470, HR-634, HR-606, HR-607, LR-1065, LR-574, LR-143, LR-396, LR-637, LR-162, LR-469, LR-216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117 from Mitsubishi Rayon Ltd.; Esrec P SE-0020, SE-0040, SE-0070, SE-0100, SE-1010, SE-1035 from Sekisui Chemical Co., Ltd.; Himer ST95 and ST120 from Sanyo Chemical Industries, Ltd.; and FM601 from Mitsui Chemicals, Inc., and the like.

The polyvinyl chloride resin and the like (v) include, for example, polyvinyl chloride resin, polyvinylidene chloride resin, vinyl chloride-vinyl acetate copolymer resin, vinyl chloride-vinyl propionate copolymer resin, and the like.

The polyvinyl butyral and the like (vi) include, for example, polyvinyl butyral, polyol resins, cellulose resins such as ethyl cellulose resin and cellulose acetate resin, and the like. Examples of commercial products include ones by Denki Kagaku Kogyo Kabushikikaisha, Sekisui Chemical Co., Ltd., and the like. For polyvinyl butyral and the like, it is preferable that the amount of polyvinyl butyral contained be 70% by mass or more and the average extent of polymerization is 500 or more, and more preferably 1000 or more. Examples of commercial products include Denka Butyral 3000-1, 4000-2, 5000A, and 6000C by Denki Kagaku Kogyo Kabushikikaisha; S-LEC BL-1, BL-2, BL-S, BX-L, BM-1, BM-2, BM-5, BM-S, BH-3, BX-1, BX-7; and the like.

The polycaprolactone resin and the like (vii) include, for example, polycaprolactone resin, styrene-maleic anhydride resin, polyacrylonitrile resin, polyether resin, epoxy resin, phenol resin, and the like.

The polyolefin resin and the like (viii) include, for example, polyethylene resin, polypropylene resin, copolymer resins of olefins such as ethylene, propylene, or the like with other vinyl monomers, acrylic resins, and the like.

The thermoplastic resins may be used alone or in combination of two or more, and in addition, a mixture, a copolymer of these resins, and the like may be used.

The thermoplastic resin preferably satisfies toner image-receiving layer properties, which will be described later, when formed into a toner image-receiving layer, and more preferably satisfies the toner image-receiving layer properties by itself. It is also preferable to use in combination two or more resins which have different toner image-receiving layer properties.

The thermoplastic resin preferably has a molecular weight that is larger than that of a thermoplastic resin used in the toner. However, according to the relationship of the thermodynamic properties of the thermoplastic resin used in the toner and the properties of the resin used in the toner image-receiving layer, the relationship of the molecular weights as described above is not necessarily preferable. For example, when a softening temperature of the resin used in the toner image-receiving layer is higher than that of the thermoplastic resin used in the toner, there are cases in which molecular weight of the resin used in the toner image-receiving layer is preferably the same or smaller.

It is also preferred that the thermoplastic resin be a mixture of resins with identical compositions having different average molecular weights. The preferable relationship with molecular weights of thermoplastic resins used in toners is disclosed in JP-A No. 08-334915.

Molecular weight distribution of the thermoplastic resin is preferably wider than that of the thermoplastic resin used in the toner.

It is preferred that the thermoplastic resin satisfies the physical properties disclosed in JP-A Nos. 05-127413, 08-194394, 08-334915, 08-334916, 09-171265, 10-221877, and the like.

It is particularly preferable that the thermoplastic resin used in a toner image-receiving layer be an aqueous resin such as water-soluble resin, water-dispersible resin, or the like for the following reasons (1) and (2).

(1) Since no organic solvent is discharged in coating and drying processes, it is excellent in environmental preservation and workability. (2) Since many release agents such as wax are difficult to dissolve in a solvent at room temperature, often they are dispersed in a solvent (water or an organic solvent) before use. Further, an aqueous dispersion is more stable and is excellently suitable for a manufacturing process. In addition, with aqueous coating, wax bleeds on the surface more easily during the process of coating and drying, and the effects of a release agent (offset resistance, adhesion resistance, and the like) is facilitated more easily.

The aqueous resin is not particularly limited with regards to its composition, bonding structure, molecular weight, molecular weight distribution, and formation, provided that it is an aqueous resin, water-dispersible resin, or the like. Examples of substituting groups which render a resin aqueous include sulfonic acid group, hydroxyl group, carboxylic acid group, amino group, amide group, ether group, and the like.

Examples of the water-soluble resins are given on page 26 of Research Disclosure No. 17,643, page 651 of Research Disclosure No. 18,716, pp. 873–874 of Research Disclosure No. 307,105, and pp. 71–75 of JP-A No. 64-13546.

Specific examples include a vinyl pyrrolidone-vinyl acetate copolymer, styrene-vinyl pyrrolidone copolymer, styrene-maleic anhydride copolymer, water-soluble polyester, water-soluble acrylic, water-soluble polyurethane, water-soluble nylon, a water-soluble epoxy resin, and the like. Gelatin may be selected from lime treated gelatin, acid treated gelatin, or so-called delimed gelatin in which the amount of calcium and the like is reduced, and it may also be used in combination. Examples of commercial products of aqueous polyester include various Plascoat products by Goo Chemical Co., Ltd., Finetex ES series by Dainippon Ink and Chemicals Inc., and the like; and those of aqueous acrylic resins include Jurymer AT series by Nihon Junyaku Co., Ltd., Finetex 6161 and K-96 by Dainippon Ink and Chemicals Inc., Hiros NL-1189 and BH-997 by Seiko Chemical Industries Co., Ltd., and the like.

The water-dispersible resin may suitably be selected from water-dispersed resins such as water-dispersed acrylic resin, water-dispersed polyester resin, water-dispersed polystyrene resin, water-dispersed urethane resin, and the like; emulsions such as acrylic resin emulsion, polyvinyl acetate emulsion, SBR (styrene butadiene rubber) emulsion, and the like; resins and emulsions in which the thermoplastic resins of (i) to (viii) are water dispersed; and copolymers thereof, mixtures thereof, and those which are cation-modified. Two or more of these may be used in combination.

Examples of commercial products of the water-dispersible resins include, for polyester resins, Vylonal series by Toyobo Co., Ltd., Pesresin A series by Takamatsu Oil & Fat Co., Ltd., Tuftone UE series by Kao Corp., Nichigo Polyester WR series by Nippon Synthetic Chemical Industry Co., Ltd., Elitel series by Unitika Ltd., and the like; and for acrylic resins, Hiros XE, KE, and PE series by Seiko Chemical Industries Co., Ltd., Jurymer ET series by Nihon Junyaku Co., Ltd., and the like.

The minimum film-forming temperature (MFT) of the polymer is preferably room temperature or higher, from the viewpoint of pre-print storage, and preferably 100° C. or lower, from the viewpoint of fixing toner particles.

It is desirable to use a self-dispersing water-dispersible polyester resin emulsion satisfying the following properties (1) to (4) as the above-mentioned thermoplastic resin in present invention. As this is a self-dispersing type which does not use a surfactant, its hygroscopicity is low even in a high humidity environment, its softening point is not much reduced by moisture, and offset produced during fixing, or sticking of sheets in storage, can be suppressed. Moreover, since it is aqueous, it is very environment-friendly and has excellent workability. As it uses a polyester resin which easily assumes a molecular structure with high cohesion energy, it has sufficient hardness in a storage environment, assumes a melting state of low elasticity (low viscosity) in the fixing step for electrophotography, and toner is embedded in the toner image-receiving layer so that a sufficiently high image quality is attained.

(1) The number average molecular weight (Mn) is preferably 5000 to 10000, and more preferably 5000 to 7000.

(2) The molecular weight distribution (Mw/Mn) (weight average molecular weight/number average molecular weight) is preferably 4 or less, and more preferably 3 or less.

(3) The glass transition temperature (Tg) is preferably 40° C. to 100° C., and more preferably 50° C. to 80° C.

(4) The volume average particle diameter is preferably 20 nm to 200 nm, and more preferably 40 nm to 150 nm.

The content of the thermoplastic resin in the toner image-receiving layer is preferably 10% by mass to 90% by mass, more preferably 10% by mass to 70% by mass, and still more preferably 20% by mass to 60% by mass.

-Releasing Agent-

The releasing agent can be at least one of silicone compounds, fluorine compounds, waxes, and matting agents. Among them, at least one selected from silicone oils, polyethylene waxes, carnauba waxes, silicone particles, and polyethylene wax particles is preferably used.

Specifically, the releasing agent may for example be a compound mentioned in "Properties and Applications of Wax (Revised)" by Saiwai Publishing, or in the Silicone Handbook published by THE NIKKAN KOGYO SHIMBUN. Also, the silicone compounds, fluorine compounds and wax in the toners mentioned in Japanese Patent Application Publication (JP-B) No. 59-38581, Japanese Patent Application Publication (JP-B) No. 04-32380, Japanese Patent (JP-B) No. 2838498, JP-B No. 2949558, Japanese Patent Application Laid-Open (JP-A) No. 50-117433, No. 52-52640, No. 57-148755, No. 61-62056, No. 61-62057, No. 61-118760, and JP-A No. 02-42451, No. 03-41465, No. 04-212175, No. 04-214570, No. 04-263267, No. 05-34966, No. 05-119514, No. 06-59502, No. 06-161150, No. 06-175396, No. 06-219040, No. 06-230600, No. 06-295093, No. 07-36210, No. 07-43940, No. 07-56387, No. 07-56390, No. 07-64335, No. 07-199681, No. 07-223362, No. 07-287413, No. 08-184992, No. 08-227180, No. 08-248671, No. 08-248799, No. 08-248801, No. 08-278663, No. 09-152739, No. 09-160278, No. 09-185181, No. 09-319139, No. 09-319143, No. 10-20549, No. 10-48889, No. 10-198069, No. 10-207116, No. 11-2917, No. 11-44969, No. 11-65156, No. 11-73049 and No. 11-194542 may be used. These compounds can also be used in combination of two or more.

Examples of the silicone compounds include non-modified silicone oils (specifically, dimethyl siloxane oil, methyl hydrogen silicone oil, phenyl methyl-silicone oil, or commercial products such as KF-96, KF-96L, KF-96H, KF-99, KF-50, KF-54, KF-56, KF-965, KF-968, KF-994, KF-995 and HIVAC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 series, TSF451 series, TSF456, TSF458 series, TSF483, TSF484, TSF4045, TSF4300, TSF4600, YF33 series, YF-3057, YF-3800, YF-3802, YF-3804, YF-3807, YF-3897, XF-3905, XS69-A1753, TEX100, TEX101, TEX102, TEX103, TEX104, TSW831, and the like from GE Toshiba Silicones), amino-modified silicone oils (for example, KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700, TSF4701, TSF4702, TSF4703, TSF4704, TSF4705, TSF4706, TEX150, TEX151 and TEX154 from GE Toshiba Silicones), carboxy-modified silicone oils (for example, BY16-880 from Dow Corning Toray Silicone Co., Ltd., TSF4770 and XF42-A9248 from GE Toshiba Silicones), carbinol-modified silicone oils (for example, XF42-B0970 from GE Toshiba Silicones), vinyl-modified silicone oils (for example, XF40-A1987 from GE Toshiba Silicones), epoxy-modified silicone oils (for example, SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from GE Toshiba Silicones), polyether-modified silicone oils (for example, KF-351 (A), KF-352 (A), KF-353 (A), KF-354 (A), KF-355 (A), KF-615(A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from GE Toshiba Silicones), silanol-modified silicone oils, methacryl-modified silicone oil, mercapto-modified silicone oil, alcohol-modified silicone oil (for example, SF8427 and SF8428 from Dow Corning Toray Silicone Co., Ltd., TSF4750, TSF4751 and XF42-B0970 from GE Toshiba Silicones), alkyl-modified silicone oils (for example, SF8416 from Dow Corning Toray Silicone Co., Ltd., TSF410, TSF411, TSF4420, TSF4421, TSF4422, TSF4450, XF42-334, XF42-A3160 and XF42-A3161 from GE Toshiba Silicones), fluorine-modified silicone oils (for example, FS1265 from Dow Corning Toray Silicone Co., Ltd., and FQF501 from GE Toshiba Silicones), silicone rubbers and silicone fine particles (for example, SH851U, SH745U, SH55UA, SE4705U, SH502 UA&B, SRX539U, SE6770 U-P, DY38-038, DY38-047, Torayfil F-201, F-202, F-250, R-900, R-902A, E-500, E-600, E-601, E-506, BY29-119 from Dow Corning Toray Silicone Co., Ltd.; Tospearl 105, Tospearl 120, Tospearl 130, Tospearl 145, Tospearl 240 and Tospearl 3120 from GE Toshiba Silicones), silicone-modified resins (specifically, olefin resins, polyester resins, vinyl resins, polyamide resins, cellulosic resins, phenoxy resins, vinyl chloride-vinyl acetate resins, urethane resins, acrylic resins, styrene-acrylic resins, compounds in which copolymerization resins thereof are modified by silicone, and the like), and the like. Examples of the commercial products include Daiallomer SP203V, SP712, SP2105 and SP3023 from Dainichiseika Color & Chemicals Mfg. Co., Ltd.; Modiper FS700, FS710, FS720, FS730 and FS770 from NOF Corp.; Symac US-270, US-350, US-352, US-380, US-413, US-450, Reseda GP-705, GS-30, GF-150 and GF-300 from TOAGOSEI CO., LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from GE Toshiba Silicones), and reactive silicone compounds (specifically, addition reaction type, peroxide-curing type and ultraviolet radiation curing type. Commercial examples thereof include: TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from GE Toshiba Silicones), and the like.

Examples of the fluorine compounds include fluorine oils (for example, Daifluoryl #1, Daifluoryl #3, Daifluoryl #10, Daifluoryl #20, Daifluoryl #50, Daifluoryl #100, Unidyne TG-440, TG-452, TG-490, TG-560, TG-561, TG-590, TG-652, TG-670U, TG-991, TG-999, TG-3010, TG-3020 and TG-3510 from Daikin Industries, Ltd.; MF-100, MF-110, MF-120, MF-130, MF-160 and MF-160E from Tohkem Products; S-111, S-112, S-113, S-121, S-131, S-132, S-141 and S-145 from Asahi Glass Co., Ltd.; and, FC-430 and FC-431 from DU PONT-MITSUI FLUORO-CHEMICALS COMPANY, LTD.), fluoro rubbers (for example, LS63U from Dow Corning Toray Silicone Co., Ltd.), fluorine-modified resins (for example, Modepa F200, F220, F600, F220, F600, F2020, F3035 from Nippon Oils and Fats; Diaroma FF203 and FF204 from Dai Nichi Pure Chemicals; Saflon S-381, S-383, S-393, SC-101, SC-105, KH-40 and SA-100 from Asahi Glass Co., Ltd.; EF-351, EF-352, EF-801, EF-802, EF-601, TFE, TFEA, TFEMA and PDFOH from Tohkem Products; and THV-200P from Sumitomo 3M), fluorine sulfonic acid compound (for example, EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS and LFBS from Tohkem Products), fluorosulfonic acid, and fluorine acid compounds or salts (specifically, anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid, ammonium perfluorooctanoate, and the like), inorganic fluorides (specifically, aluminum fluoride, potassium fluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid, potassium hexafluorinated phosphoric acid, and the like).

Examples of the wax include synthetic hydrocarbon, modified wax, hydrogenated wax, natural wax, and the like.

Examples of the synthetic hydrocarbon include polyethylene wax (for example, polyron A, 393, and H-481 from Chukyo Yushi Co., Ltd.; Sunwax E-310, E-330, E-250P, LEL-250, LEL-800, LEL-400P, from SANYO KASEI Co., Ltd.), polypropyrene wax (for example, biscoal 330-P, 550-P, 660-P from SANYO KASEI Co., Ltd.), Fischer toropush wax (for example, FT100, and FT-0070, from Nippon Seiro Co., Ltd.), an acid amide compound or an acid imide compound (specifically, stearic acid amide, anhydrous phthalic acid imide, or the like; for example, Cellusol 920, B-495, hymicron G-270, G-110, hydrine D-757 from Chukyo Yushi Co., Ltd.), and the like.

Examples of the modified wax include amine-modified polypropyrene (for example, QN-7700 from SANYO KASEI Co., Ltd.), acrylic acid-modified wax, fluorine-modified wax, olefin-modified wax, urethane wax (for example, NPS-6010, and HAD-5090 from Nippon Seiro Co., Ltd.), alcohol wax (for example, NPS-9210, NPS-9215, OX-1949, XO-020T from Nippon Seiro Co., Ltd.), and the like.

Examples of the hydrogenated wax include cured castor oil (for example, castor wax from Itoh Oil Chemicals Co., Ltd.), castor oil derivatives (for example, dehydrated castor oil DCO, DCO Z-1, DCO Z-3, castor oil aliphatic acid CO-FA, ricinoleic acid, dehydrated castor oil aliphatic acid DCO-FA, dehydrated castor oil aliphatic acid epoxy ester D-4 ester, castor oil urethane acrylate CA-10, CA-20, CA-30, castor oil derivative MINERASOL S-74, S-80, S-203, S42X, S-321, special castor oil condensation aliphatic acid MINERASOL RC-2, RC-17, RC-55, RC-335, special castor oil condensation aliphatic acid ester MINERASOL LB-601, LB-603, LB-604, LB-702, LB-703, #11 and L-164 from Itoh Oil Chemicals Co., Ltd.), stearic acid (for example, 12-hydroxystearic acid from Itoh Oil Chemicals Co., Ltd.), lauric acid, myristic acid, palmitic acid, behenic acid, sebacic acid (for example, sebacic acid from Itoh Oil Chemicals Co., Ltd.), undecylenic acid (for example, undecylenic acid from Itoh Oil Chemicals Co., Ltd.), heptyl acids (heptyl acids from Itoh Oil Chemicals Co., Ltd.), maleic acid, high grade maleic oils (for example, HIMALEIN DC-15, LN-10, LN-00-15, DF-20 and SF-20 from Itoh Oil Chemicals Co., Ltd.), blown oils (for example, selbonol #10, #30, #60, R-40 and S-7 from Itoh Oil Chemicals Co., Ltd.), cyclopentadieneic oil (CP oil and CP oil-S from Itoh Oil Chemicals Co., Ltd., or the like), and the like.

The natural wax is preferably any wax selected from vegetable wax, animal wax, mineral wax, and petroleum wax, among which vegetable wax is particularly preferable. The natural wax is also preferably a water-dispersible wax, from the viewpoint of compatibility when a water-dispersible thermoplastic resin is used as the thermoplastic resin in the toner image-receiving layer.

Examples of the vegetable wax include carnauba wax (for example, EMUSTAR AR-0413 from Nippon Seiro Co., Ltd., and Cellusol 524 from Chukyo Yushi Co., Ltd.), castor oil (purified castor oil from Itoh Oil Chemicals Co., Ltd.), rapeseed oil, soybean oil, Japan tallow, cotton wax, rice wax, sugarcane wax, candellila wax, Japan wax, jojoba oil, and the like. Of these, carnauba wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

Examples of the animal wax include bees wax, lanolin, spermaceti, whale oil, wool wax, and the like.

Examples of the mineral wax include montan wax, montan ester wax, ozokerite, ceresin, and the like, aliphatic acid esters (Sansosizer-DOA, AN-800, DINA, DIDA, DOZ, DOS, TOTM, TITM, E-PS, nE-PS, E-PO, E-4030, E-6000, E-2000H, E-9000H, TCP, C-1100, and the like, from New Japan Chemical Co., Ltd.), and the like. Of these, montan wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

Examples of the petroleum wax include paraffin wax (for example, Paraffin wax 155, Paraffin wax 150, Paraffin wax 140, Paraffin wax 135, Paraffin wax 130, Paraffin wax 125, Paraffin wax 120, Paraffin wax 115, HNP-3, HNP-5, HNP-9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Nippon Oils and Fats Co., Ltd.; Cellosol 686, Cellosol 428, Cellosol 651-A, Cellosol A, H-803, B-460, E-172, E-866, K-133, hydrin D-337 and E-139 from Chukyo Yushi Co., Ltd.; 125° paraffin, 125° FD, 130° paraffin, 135° paraffin, 135° H, 140° paraffin, 140° N, 145° paraffin and paraffin wax M from Nippon Oil Corporation), or a microcrystalline wax (for example, Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042X from Nippon Oils and Fats Co., Ltd; Cellosol 967, M, from Chukyo Yushi Co., Ltd.; 155 Microwax and 180 Microwax from Nippon Oil Corporation), and petrolatum (for example, OX-1749, OX-0450, OX-0650B, OX-0153, OX-261BN, OX-0851, OX-0550, OX-0750B, JP-1500, JP-056R and JP-011P from Nippon Oils and Fats Co., Ltd.), and the like.

A content of the natural wax in the toner image-receiving layer (a surface) is preferably 0.1 $g/m^2$ to 4 $g/m^2$, and more preferably 0.2 $g/m^2$ to 2 $g/m^2$.

If the content is less than 0.1 $g/m^2$, the anti-offset properties and the adhesive resistance deteriorate. If the content is more than 4 $g/m^2$, the quality of an image may deteriorate because of the excessive amount of wax.

The melting point of the natural wax is preferably 70° C. to 95° C., and more preferably 75° C. to 90° C., from a viewpoint of anti-offset properties and paper transporting properties.

The matting agent can be selected from any known matting agent. Solid particles for use in the matting agents can be classified as inorganic particles (inorganic matting agents) and organic particles (organic matting agents).

Specifically, the inorganic matting agents may be oxides (for example, silicon dioxide, titanium oxide, magnesium oxide, aluminum oxide), alkaline earth metal salts (for example, barium sulfate, calcium carbonate, and magnesium sulfate), silver halides (for example, silver chloride, and silver bromide), glass, and the like.

Examples of the inorganic matting agents can be found, for example, in West German Patent No. 2529321, the U.K. Patent Nos. 760775, 1260772, and the U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Materials of the organic matting agent include starch, cellulose ester (for example, cellulose-acetate propionate), cellulose ether (for example, ethyl cellulose) and a synthetic resin. It is preferred that the synthetic resin is insoluble or difficult to become solved. Examples of insoluble or difficult to become solved in synthetic resins include poly(meth) acrylic acid esters (for example, polyalkyl(meth)acrylate, polyalkoxyalkyl(meth)acrylate, polyglycidyl(meth)acrylate), poly(meth) acrylamide, polyvinyl ester (for example, polyvinyl acetate), polyacrylonitrile, polyolefins (for example, polyethylene), polystyrene, benzoguanamine resin, formaldehyde condensation polymer, epoxy resin, polyamide, polycarbonate, phenolic resin, polyvinyl carbazole, polyvinylidene chloride, and the like. Copolymers which combine the monomers used in the above polymers, may also be used.

In the case of the copolymers, a small amount of hydrophilic repeated units may be included. Examples of monomers which form a hydrophilic repeated unit include acrylic acid, methacrylic acid, α,β-unsaturated dicarboxylic acid, hydroxyalkyl(meth)acrylate, sulfoalkyl (meth)acrylate, styrene sulfonic acid, and the like.

Examples of the organic matting agents can be found, for example, in the U.K. Patent No. 1055713, the U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, and 57-14835.

Also, two or more types of solid particles may be used in conjunction as matting agents. The average particle size of the solid particles of the matting agent may suitably be, for example, 1 μm to 100 μm, and is more preferably 4 μm to 30 μm. The usage amount of the matting agent may suitably be 0.01 $g/m^2$ to 0.5 $g/m^2$, and is more preferably 0.02 $g/m^2$ to 0.3 $g/m^2$.

The releasing agents for use in the toner-image-receiving layer can also be derivatives, oxides, purified products, and mixtures of the aforementioned substances. These may also have reactive substituents.

The melting point of the releasing agent is preferably 70° C. to 95° C., and more preferably 75° C. to 90° C., from the viewpoints of anti-offset properties and paper transport properties.

The releasing agent is also preferably a water-dispersible releasing agent, from the viewpoint of compatibility when a water-dispersible thermoplastic resin is used as the thermoplastic resin in the toner image-receiving layer.

The content of the releasing agent in the toner image-receiving layer is preferably 0.1% by mass to 10% by mass, more preferably 0.3% by mass to 8.0% by mass, and still more preferably 0.5% by mass to 5.0% by mass.

-Other Components-

Other components include various additives which are added in order to improve thermoplastic properties of a toner image-receiving layer, for example, a colorant, plasticizer, filler, cross-linking agent, electrification control agent, emulsifier, dispersant, and the like. Other components which are to be contained in a toner image-receiving layer preferably have a shape of hollow particles, from the viewpoint that they have excellent thermal conductivity (low thermal conductivity) during image fixing, and it is particularly preferable that the pigment have a shape of hollow particles.

Examples of colorants include fluorescent whitening agents, white pigments, colored pigments, dyes, and the like.

The fluorescent whitening agent has absorption in the near-ultraviolet region, and is a compound which emits fluorescence at 400 nm to 500 nm. The various fluorescent whitening agent known in the art may be used without any particular limitation. Examples of the fluorescent whitening agent include the compounds described in "The Chemistry of Synthetic Dyes" Volume V, Chapter 8 edited by K. VeenRataraman. Specific examples of the fluorescent whitening agent include stilbene compounds, coumarin compounds, biphenyl compounds, benzo-oxazoline compounds, naphthalimide compounds, pyrazoline compounds, carbostyryl compounds, and the like. Examples of the commercial fluorescent whitening agents include WHITEX PSN, PHR, HCS, PCS, and B from Sumitomo Chemicals, UVITEX-OB from Ciba-Geigy, Co., Ltd., and the like.

Examples of the white pigments include the inorganic pigments (for example, titanium oxide, calcium carbonate, and the like).

Examples of the colored pigments include various pigments and azo pigments described in JP-A No. 63-44653, (for example, azo lakes such as carmine 6B and red 2B, insoluble azo compounds such as monoazo yellow, disazo yellow, pyrazolo orange, Balkan orange, and condensed azo compounds such as chromophthal yellow and chromophthal red), polycyclic pigments (for example, phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (for example, malachite green, rhodamine B, rhodamine G and Victoria blue B), and inorganic pigment (for example, oxide, titanium dioxide, iron oxide red, sulfate; settling barium sulfate, carbonate; settling calcium carbonate, silicate; hydrous silicate, silicic anhydride, metal powder; alminium powder, bronze powder, zinc powder, carbon black, chrome yellow, iron blue, or the like) and the like.

These may be used either alone, or in combination of two or more. Of these, titanium oxide is particularly preferred as the pigment.

There is no particular limitation on the form of the pigment. However, hollow particles are preferred from the viewpoint that they have excellent heat conductivity (low heat conductivity) during image fixing.

The various dyes including oil-soluble dyes, water-insoluble dyes, and the like may be used as the dye.

Examples of oil-soluble dyes include anthraquinone compounds, azo compounds, and the like.

Examples of water-insoluble dyes include vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35, or the like; disperse dyes such as C.I. disperse violet 1, C.I. disperse violet 4, C.I. disperse violet 10, C.I. disperse blue 3, C.I. disperse blue 7, C.I. disperse blue 58, or the like; and other dyes such as C.I. solvent violet 13, C.I. solvent violet 14, C.I. solvent violet 21, C.I. solvent violet 27, C.I. solvent blue 11, C.I. solvent blue 12, C.I. solvent blue 25, C.I. solvent blue 55, or the like.

Colored couplers used in silver halide photography may also be preferably used.

A content of the colorant in the toner image-receiving layer (surface) is preferably 0.1 $g/m^2$ to 8 $g/m^2$, and more preferably 0.5 $g/m^2$ to 5 $g/m^2$.

If the content of colorant is less than 0.1 $g/m^2$, the light transmittance in the toner image-receiving layer becomes high. If it is more than 8 $g/m^2$, handling becomes more difficult, due to crack and adhesive resistance.

In the colorant, an amount of the pigment to be added is, based on the mass of the thermoplastic resin which forms the toner image-receiving layer, preferably 40% by mass or less, more preferably 30% by mass or less, and still more preferably 20% by mass or less.

The plasticizers known in the art may be used without any particular limitation. These plasticizers have the effect of adjusting the fluidity or softening of the toner image-receiving layer due to heat and/or pressure.

The plasticizer may be selected by referring to "Chemical Handbook," (Chemical Institute of Japan, Maruzen), "Plasticizers—their Theory and Application," (ed. Koichi Murai, Saiwai Shobo), "The Study of Plasticizers, Part 1" and "The Study of Plasticizers, Part 2" (Polymer Chemistry Association), or "Handbook of Rubber and Plastics Blending Agents" (ed. Rubber Digest Co.), or the like.

Examples of the plasticizers include phthalic esters, phosphate esters, aliphatic acid esters, abiethyne acid ester, abietic acid ester, sebacic acid esters, azelinic ester, benzoates, butylates, epoxy aliphatic acid esters, glycolic acid esters, propionic acid esters, trimellitic acid esters, citrates, sulfonates, carboxylates, succinic acid esters, maleates, fumaric acid esters, phthalic acid esters, stearic acid esters, and the like; amides (for example, aliphatic acid amides and sulfoamides); ethers; alcohols; lactones; polyethyleneoxy; and the like (See, for example, JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, 62-174754, 62-245253, 61-209444, 61-200538, 62-8145, 62-9348, 62-30247, 62-136646 and 02-235694, and the like). The plasticizers can be mixed into a resin.

The plasticizers may be polymers having relatively low molecular weight. In this case, it is preferred that the molecular weight of the plasticizer is lower than the molecular weight of the binder resin to be plasticized. Preferably, plasticizers have a molecular weight of 15000 or less, or more preferably 5000 or less. When a polymer plasticizer is used as the plasticizer, the polymer of the polymer plasticizer is the same as that of the binder resin to be plasticized. For example, when the polyester resin is plasticized, polyester having low molecular weight is preferable. Further, oligomers may also be used as plasticizers. Apart from the compounds mentioned above, there are commercially products such as, for example, Adecasizer PN-170 and PN-1430 from Asahi Denka Co., Ltd.; PARAPLEX-G-25, G-30 and G-40 from C.P.Hall; and, rosin ester 8 L-JA, ester R-95, pentalin 4851, FK 115, 4820, 830, Ruizol 28-JA, Picolastic A75, Picotex LC and Cristalex 3085 from Rika Hercules, Inc, and the like.

The plasticizer can be used as desired to relax stress and distortion (physical distortions of elasticity and viscosity, and distortions of mass balance in molecules, binder main chains or pendant portions) which are produced when toners are embedded in the toner image-receiving layer.

The plasticizer may be dispersed in micro in the toner image-receiving layer. The plasticizer may also be dispersed in micro in a state of sea-island, in the toner image-receiving layer. The plasticizer may present in the toner image-receiving layer in a state of sufficiently mixed with other components such as binder or the like.

The content of plasticizer in the toner image-receiving layer is preferably 0.001% by mass to 90% by mass, more preferably 0.1% by mass to 60% by mass, and still more preferably 1% by mass to 40% by mass.

The plasticizer may be used for the purpose of adjusting slidability (improvement of transportability by reducing friction), improving fixing part offset (release of toner or layer to the fixing part), adjusting electrification (formation of a toner electrostatic image), and the like.

The filler may be an organic or inorganic filler. Reinforcers for binder resins, bulking agents and reinforcements known in the art may be used.

The filler may be one of those described in "Handbook of Rubber and Plastics Additives" (ed. Rubber Digest Co.), "Plastics Blending Agents—Basics and Applications" (New Edition) (Taisei Co.), "The Filler Handbook" (Taisei Co.), or the like.

As the filler, various inorganic fillers (or pigments) can be used. Examples of inorganic pigments include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, mullite, and the like. Silica and alumina are particularly preferred. These fillers may be used either alone or in combination of two or more. It is preferred that the filler has a small particle diameter. If the particle diameter is large, the surface of the toner image-receiving layer may tend to become rough.

Examples of the silica include spherical silica and amorphous silica. The silica may be synthesized by the dry method, wet method or aerogel method. The surface of the hydrophobic silica particles may also be treated by trimethylsilyl groups or silicone. Colloidal silica is preferred. The average particle diameter of the silica is preferably 4 nm to 120 nm, and more preferably 4 nm to 90 nm.

The silica is preferably porous. The average pore size of porous silica is preferably 50 nm to 500 nm. The average pore volume per mass of porous silica is preferably 0.5 ml/g to 3 ml/g, for example.

The alumina includes anhydrous alumina and hydrated alumina. Examples of crystallized anhydrous aluminas which may be used, are α, β, γ, δ, ζ, η, θ, κ, ρ, or χ. Hydrated alumina is preferred to anhydrous alumina. The hydrated alumina may be a monohydrate or trihydrate. Monohydrates include pseudo-boehmite, boehmite and diaspore. Trihydrates include gibbsite and bayerite. The average particle diameter of alumina is preferably 4 nm to 300 nm, and more preferably 4 nm to 200 nm. Porous alumina is preferred. The average pore size of porous alumina is preferably 50 nm to 500 nm. The average pore volume per mass of porous alumina is around 0.3 ml/g to 3 ml/g.

The alumina hydrate can be synthesized by the sol-gel method, in which ammonia is added to an aluminum salt solution to precipitate alumina, or by hydrolysis of an alkali aluminate. Anhydrous alumina can be obtained by dehydrating alumina hydrate by the action of heat.

The filler is preferably from 5 parts by mass to 2000 parts by mass relative to 100 parts of the dry mass of the binder of a layer to which it is added.

A crosslinking agent can be added in order to adjust the storage stability or thermoplastic properties of the toner image-receiving layer. Examples of the crosslinking agent include compounds containing two or more reactive groups in the molecule, such as an epoxy group, an isocyanate group, an aldehyde group, an active halogen group, an active methylene group, an acetylene group and other reactive groups known in the art.

The cross-linking agent may also be a compound having two or more groups capable of forming bonds such as hydrogen bonds, ionic bonds, stereochemical bonds, or the like.

The cross-linking agent may be a compound known in the art such as a coupling agent for resin, curing agent, polymerizing agent, polymerization promoter, coagulant, film-forming agent, film-forming assistant, or the like. Examples of the coupling agents include chlorosilanes, vinylsilanes, epoxysilanes, aminosilanes, alkoxyaluminum chelates, titanate coupling agents, and the like. The examples further include other agents known in the art such as those mentioned in Handbook of Rubber and Plastics Additives (ed. Rubber Digest Co.).

The charge control agent preferably adjusts transfer and adhesion of toner, and prevents charge adhesion of a toner image-receiving layer.

The charge control agent may be any charge control agent known in the art. Examples of the charge control agent include surfactants such as a cationic surfactant, an anionic surfactant, an amphoteric surfactant, a nonionic surfactant, or the like; polymer electrolytes, electroconducting metal oxides, and the like.

Examples of the surfactant include cationic charge inhibitors such as quaternary ammonium salts, polyamine derivatives, cation-modified polymethylmethacrylate, cation-modified polystyrene, or the like; anionic charge inhibitors such as alkyl phosphates, anionic polymers, or the like; and nonionic charge inhibitors such as aliphatic ester, polyethylene oxide, or the like. When the toner has a negative charge, cationic charge control agent and nonionic charge control agent, for example, are preferable.

Examples of the electroconducting metal oxides include ZnO, $TiO_2$, $SnO_2$, $Al_2O_3$, $In_2O_3$, $SiO_2$, MgO, BaO, $MoO_3$, and the like. These may be used alone, or in combination of two or more.

Moreover, the metal oxide may contain other elements. For example, ZnO may contain Al, In, or the like, $TiO_2$ may contain Nb, Ta, or the like, and $SnO_2$ may contain (or, dope) Sb, Nb, halogen elements, or the like.

The materials used to obtain the toner image-receiving layer may also contain various additives to improve image stability when output, or to improve stability of the toner image-receiving layer itself. Examples of the additives include antioxidants, age resistors, degradation inhibitors, anti-ozone degradation inhibitors, ultraviolet ray absorbers, metal complexes, light stabilizers, preservatives, fungicide, and the like.

Examples of the antioxidants include chroman compounds, coumarane compounds, phenol compounds (for example, hindered phenols), hydroquinone derivatives, hindered amine derivatives, spiroindan compounds, and the like. The antioxidants can be found, for example, in JP-A No. 61-159644.

Examples of age resistors include those found in Handbook of Rubber and Plastics Additives, Second Edition (1993, Rubber Digest Co.), pp. 76–121.

Examples of the ultraviolet ray absorbers include benzotriazo compounds (described in the U.S. Pat. No. 3,533,794), 4-thiazolidone compounds (described in the U.S. Pat. No. 3,352,681), benzophenone compounds (described in JP-A No. 46-2784), ultraviolet ray absorbing polymers (described in JP-A No. 62-260152).

Examples of the metal complex include those described in U.S. Pat. Nos. 4,241,155, 4,245,018, 4,254,195, JP-A Nos. 61-88256, 62-174741, 63-199248, 01-75568, 01-74272, and the like.

Additives for photography known in the art may also be added to the material used to obtain the toner image-receiving layer as described above. Examples of the photographic additives can be found in the Journal of Research Disclosure (hereinafter referred to as RD) No. 17643 (December 1978), No. 18716 (November 1979) and No. 307105 (November 1989). The relevant sections are shown.

| Type of additive | RD17643 | RD18716 | RD307105 |
|---|---|---|---|
| 1. Whitener | p.24 | p.648 right column | p.868 |
| 2. Stabilizer | pp.24–25 | p.649 right column | pp.868–870 |
| 3. Light absorber (Ultraviolet ray absorber) | pp.25–26 | p.649 right column | pp.873 |
| 4. Colorant image stabilizer | p.25 | p.650 right column | p.872 |
| 5. Film hardener | p.26 | p.651 left column | p.874–875 |
| 6. Binder | p.26 | p.651 left column | p.873–874 |
| 7. Plasticizer, lubricant | p.27 | p.650 right column | p.876 |
| 8. Auxiliary application agent (Surfactant) | pp.26–27 | p.650 right column | pp.875–876 |
| 9. Antistatic agent | p.27 | p.650 right column | p.876–877 |
| 10. Matting agent | | | pp.878–879 |

The toner image-receiving layer of the present invention is formed by applying a coating solution which contains the polymer used for the toner image-receiving layer with a wire coater or the like onto the support, and drying the coating solution. The coating solution is prepared by dissolving or uniformly dispersing an additive such as a thermoplastic polymer, a plasticizer, or the like, into an organic solvent such as alcohol, ketone, or the like. The organic solvent used here may for example be methanol, isopropyl alcohol, methyl ethyl ketone, or the like. If the polymer used for the toner image-receiving layer is water-soluble, the toner image-receiving layer can be prepared by applying an aqueous solution of the polymer onto the support. Polymers which are not water-soluble may be applied onto the support in an aqueous dispersion.

The film-forming temperature of the polymer used in the present invention is preferably room temperature or higher, from the viewpoint of pre-print storage, and preferably 100° C. or lower, from the viewpoint of fixing toner particles.

-Physical Properties of Toner Image-receiving Layer-

The 180° separation strength of the toner image-receiving layer at the fixing temperature by the fixing member is preferably 0.1 N/25 mm or less, and more preferably 0.041 N/25 mm or less. The 180° separation strength can be measured based on the method described in JIS K6887 using the surface material of the fixing member.

It is preferred that the toner image-receiving layer has a high degree of whiteness. This whiteness is measured by the method specified in JIS P 8123, and is preferably 85% or more. It is preferred that the spectral reflectance is 85% or more in the wavelength of 440 nm to 640 nm, and that the difference between the maximum spectral reflectance and minimum spectral reflectance in this wavelength is within 5%. Further, it is preferred that the spectral reflectance is 85% or more in the wavelength of 400 nm to 700 nm, and that the difference between the maximum spectral reflectance and the minimum spectral reflectance in the wavelength is within 5%.

Specifically, for the whiteness, the value of L* is preferably 80 or higher, more preferably 85 or higher, and still more preferably 90 or higher in a CIE 1976 (L*a*b*) color space. The color tint of the white color is preferably as neutral as possible. Regarding the color tint of the whiteness, the value of $(a^*)^2+(b^*)^2$ is preferably 50 or less, more preferably 18 or less and still more preferably 5 or less in a (L*a*b*) space.

It is preferred that the toner image-receiving layer has a high surface gloss. The 45° gloss luster is preferably 60 or higher, more preferably 75 or higher, and still more preferably 90 or higher, over the whole range from white where there is no toner, to black where toner is densed at maximum.

However, the gloss luster is preferably 110 or less. If it is more than 110, the image has a metallic appearance which is undesirable.

Gloss luster may be measured by JIS Z 8741.

It is preferred that the toner image-receiving layer has a high smoothness. The arithmetic average roughness (Ra) is preferably 3 μm or less, more preferably 1 μm or less, and still more preferably 0.5 μm or less, over the whole range from white where there is no toner, to black where toner is densed at maximum.

Arithmetic average roughness may be measured by JIS B 0601, B 0651, and B 0652.

It is preferred that the toner image-receiving layer has one of the following physical properties, more preferred that it has several of the following physical properties, and most preferred that it has all of the following physical properties.

(1) $T_m$ (Melting temperature) of the toner image-receiving layer is 30° C. or more, and equal to or less than $T_m$+20° C. of the toner.

(2) The temperature at which the viscosity of the toner image-receiving layer is $1\times10^5$ cp is 40° C. or higher, lower than the corresponding temperature for the toner.

(3) At a fixing temperature of the toner image-receiving layer, the storage elasticity modulus (G') is $1\times10^2$ Pa to $1\times10^5$ Pa, and the loss elasticity modulus (G") is $1\times10^2$ Pa to $1\times10^5$ Pa.

(4) The loss tangent (G"/G'), which is the ratio of the loss elasticity modulus (G") and the storage elasticity modulus (G') at a fixing temperature of the toner image-receiving layer, is 0.01 to 10.

(5) The storage modulus (G') at a fixing temperature of the toner image-receiving layer is from −50 to +2500, relative to the storage elasticity modulus (G") at a fixing temperature of the toner.

(6) The inclination angle on the toner image-receiving layer of the molten toner is 50° or less, and particularly preferably 40° or less.

The toner image-receiving layer preferably satisfies the physical properties described in Japanese Patent No. 2788358, and JP-A Nos. 07-248637, 08-305067 and 10-239889.

Layers other than the toner image-receiving layer of the electrophotographic image-receiving sheet include, for example, a surface protective layer, intermediate layer, backing layer, contact improving layer, undercoat, cushion layer, charge control (inhibiting) layer, reflecting layer, tint adjusting layer, storage ability improving layer, anti-adhering layer, anti-curl layer, smoothing layer, and the like. These layers may have a single-layer structure or may be formed of two or more layers.

The thickness of the electrophotographic image-receiving sheet can be suitably selected according to the purpose without particular limitation. The thickness is preferably 50 μm to 350 μm, and more preferably 100 μm to 280 μm.

A surface protective layer may be disposed on the surface of the toner image-receiving layer to protect the surface of the electrophotographic image-receiving sheet, to improve storage properties, to improve ease of handling, to facilitate writing, to improve paper transporting properties within an equipment, to confer anti-offset properties, or the like. The surface protective layer may comprise one layer, or two or more layers. In the surface protective layer, various thermoplastic resins or thermosetting resins may be used as binders, and are preferably the same types of resins as those of the toner image-receiving layer. However, the thermodynamic properties and electrostatic properties are not necessarily identical to those of the toner image-receiving layer, and may be individually optimized.

The surface protective layer may comprise the various additives described above which can be used for the toner image-receiving layer. In particular, in addition to the releasing agents for the present invention, the surface protective layer may include other additives, for example matting agents or the like. The matting agents may be any of these used in the related art.

From the viewpoint of fixing properties, it is preferred that the outermost surface layer of the electrophotographic image-receiving sheet (which refers to, for example, the surface protective layer, if disposed) has good compatibility with the toner. Specifically, it is preferred that the contact angle with molten toner is, for example, from 0° to 40°.

It is preferred that, in the electrophotographic image-receiving sheet, a backing layer is disposed on the opposite surface to the surface on which the support is disposed, in order to confer back surface output compatibility, and to improve back surface output image quality, curl balance and paper transporting properties within equipment.

There is no particular limitation on the color of the backing layer. However, if the electrophotographic image-receiving sheet of the invention is a double-sided output image-receiving sheet where an image is formed also on the back surface, it is preferred that the backing layer is also white. It is preferred that the whiteness and spectral reflectance are 85% or more, for both the top surface and the back surface.

To improve double-sided output compatibility, the backing layer may have an identical structure to that of the toner image-receiving layer. The backing layer may comprise the various additives described hereintofore. Of these additives, matting agents and charge control agents are particularly suitable. The backing layer may be a single layer, or may have a laminated structure comprising two or more layers.

Further, if releasing oil is used for the fixing roller or the like, to prevent offset during fixing, the backing layer may have oil absorbing properties.

In the electrostatic image-receiving sheet, it is preferred to dispose a contact improving layer in order to improve the contact between the support and the toner image-receiving layer. The contact improving layer may contain the various additives described above. Of these, cross-linking agents are particularly preferred to be blended in the contact improving layer. Furthermore, to improve accepting properties to toner, it is preferred that the electrophotographic image-receiving sheet further comprises a cushion layer between the contact improving layer and the toner image-receiving layer.

An intermediate layer may for example be disposed between the support and a contact improvement layer, between a contact improvement layer and a cushion layer, between a cushion layer and a toner image-receiving layer, or between a toner image-receiving layer and a storage property improvement layer. In the case of an electrophotographic image-receiving sheet comprising a support, a toner image-receiving layer and an intermediate layer, the intermediate layer may of course be disposed for example between the support and the toner image-receiving layer.

<Toner>

In the electrophotographic image-receiving sheet, the toner image-receiving layer receives toners during printing or copying.

The toner contains at least a binder resin and a colorant, but may contain releasing agents and other components, if necessary.

-Binder Resin for Toner-

Examples of the binder resin include vinyl monopolymer of: styrenes such as styene, parachlorostyrene, or the like; vinyl esters such as vinyl naphthalene, vinyl chloride, vinyl bromide, vinyl fluoride, vinyl acetate, vinyl propioniate, vinyl benzoate, vinyl butyrate, or the like; methylene aliphatic carboxylates such as methyl acrylate, ethyl acrylate, n-butyl acrylate, isobutyl acrylate, dodecyl acrylate, n-octyl acrylate, 2-cloroethyl acrylate, phenyl acrylate, α-methyl chloroacrylate, methyl methacrylate, ethyl methacrylate, butyl acrylate, or the like; vinyl nitriles such as acryloniotrile, methacrylonitrile, acrylamide, or the like; vinyl ethers such as vinyl methyl ether, vinyl ethyl ether, vinyl isobutyl ether, or the like; N-vinyl compounds such as N-vinyl pyrrole, N-vinylcarbazole, N-vinyl indole, N-vinyl pyrrolidone, or the like; and vinyl carboxylic acids such as methacrylic acid, acrylic acid, cinnamic add, or the like. These vinyl monomers may be used either alone, or copolymers thereof may be used. Further, various polyesters may be used, and various waxes may be used in combination.

Of these resins, it is preferable to use a resin of the same type as the resin used for the toner image-receiving layer of the present invention.

-Colorants for Toner-

The colorants generally used in the art can be used without limitation. Examples of the colorants include various pigments such as carbon black, chrome yellow, Hansa yellow, benzidine yellow, threne yellow, quinoline yellow, permanent orange GTR, pyrazolone orange, Balkan orange, watch young red, permanent red, brilliant carmin 3B, brilliant carmin 6B, dippon oil red, pyrazolone red, lithol red, rhodamine B lake, lake red C, rose bengal, aniline blue, ultramarine blue, chalco oil blue, methylene blue chloride, phthalocyanine blue, phthalocyanine green, malachite green oxalate, or the like. Various dyes may also be added such as acridine, xanthene, azo, benzoquinone, azine, anthraquinone, thioindigo, dioxadine, thiadine, azomethine, indigo, thioindigo, phthalocyanine, aniline black, polymethine, triphenylmethane, diphenylmethane, thiazine, thiazole, xanthene, or the like. These colorants may be used either alone, or in combination of a plurality of colorants.

It is preferred that the content of the colorant is 2% by mass to 8% by mass. If the content of colorant is 2% by mass or more, the coloration does not become weaker. If it is 8% by mass or less, transparency does not deteriorate.

-Releasing Agent for Toner-

The releasing agent for the toner may be in principle any of the wax known in the art. Polar wax containing nitrogen such as highly crystalline polyethylene wax having relatively low molecular weight, Fischertropsch wax, amide wax, urethane wax, and the like are particularly effective. The molecular weight of the polyethylene wax is preferably 1000 or less, and more preferably from 300 to 1000.

Compounds containing urethane bonds have a solid state due to the strength of the cohesive force of the polar groups even if the molecular weight is low, and as the melting point can be set high in view of the molecular weight, they are suitable. The preferred molecular weight is 300 to 1000. The initial materials may be selected from various combinations such as a diisocyane acid compound with a mono-alcohol, a monoisocyanic acid with a mono-alcohol, dialcohol with mono-isocyanic acid, tri-alcohol with a monoisocyanic acid, and a triisocyanic acid compound with mono-alcohol. However, in order to prevent the molecular weight from becoming too large, it is preferable to combine a compound having multiple functional groups with another compound having one functional group, and it is important that the amount of functional groups be equivalent Among the initial materials, examples of the monoisocyanic acid compounds include dodecyl isocyanate, phenyl isocyanate and derivatives thereof, naphthyl isocyanate, hexyl isocyanate, benzyl isocyanate, butyl isocyanate, allyl isocyanate, and the like.

Examples of the diisocyanic acid compounds include tolylene diisocyanate, 4'-diphenylmethane diisocyanate, toluene diisocyanate, 1,3-phenylene diisocyanate, hexamethylene diisocyanate, 4-methyl-m-phenylene diisocyanate, isophorone diisocyanate, and the like.

Examples of the mono-alcohol include ordinary alcohols such as methanol, ethanol propanol, butanol, pentanol, hexanol, heptanol, and the like.

Among the initial materials, examples of the di-alcohols include numerous glycols such as ethylene glycol, diethylene glycol, triethylene glycol, trimethylene glycol, or the like; and examples of the tri-alcohols include trimethylol propane, triethylol propane, trimethanolethane, and the like. The present invention is not necessarily limited these examples, however.

These urethane compounds may be mixed with the resin or the colorant during kneading, as an ordinary releasing agent, and used also as a kneaded-crushed toner. Further, in a case of using an emulsion polymerization cohesion scorification toner, the urethane compounds may be dispersed in water together with an ionic surfactant, polymer acid or polymer electrolyte such as a polymer base, heated above the melting point, and converted to fine particles by applying an intense shear in a homogenizer or pressure discharge dispersion machine to manufacture a releasing agent particle dispersion of 1 μm or less, which can be used together with a resin particle dispersion, colorant dispersion, or the like.

-Toner, Other Components-

The toner may also contain other components such as internal additives, charge control agents, inorganic particles, or the like. Examples of the internal additives include metals such as ferrite, magnetite, reduced iron, cobalt, nickel, manganese, or the like; alloys or magnets such as compounds containing these metals.

Examples of the charge control agents include dyes such as quaternary ammonium salt, nigrosine compounds, dyes made from complexes of aluminum, iron and chromium, or triphenylmeiane pigments. The charge control agent can be selected from the ordinary charge control agent. Materials which are difficult to become solved in water are preferred from the viewpoint of controlling ionic strengtfi which affects cohesion and stability during melting, and the viewpoint of less waste water pollution The inorganic fine particles may be any of the external additives for toner surfaces generally used, such as silica, alumina, titania, calcium carbonate, magnesium carbonate, ticalcium phosphate, or the like. It is preferred to disperse these with an ionic surfactant, polymer acid or polymer base.

Surfactants can also be used for emulsion polymerization, seed polymerization, pigment dispersion, resin particle dispersion, releasing agent dispersion, cohesion or stabilization thereof. For example, it is effective to use, in combination, anionic surfactants such as sulfuric acid ester salts, sulfonic acid salts, phosphoric acid esters, soaps, or the like; cationic surfactants such as amine salts, quaternary ammonium salts, or the like; or non-ionic surfactants such as polyethylene glycols, alkylphenol ethylene oxide adducts, polybasic alcohols, or the like. These may generally be dispersed by a rotary shear homogenizer or a ball mill, sand mill, dyno mill, or the like, all of which contain the media.

The toner may also contain an external additive, if necessary. Examples of the external additive include inorganic powder, organic particles, and the like. Examples of the inorganic particles include $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, CaO $SiO_2$, $K_2O$ $(TiO_2)_n$, $Al_2O_3$ $2SiO_2$, $CaCO_3$, $MgCO_3$, $BaSO_4$, $MgSO_4$, and the like. Examples of the organic particles include aliphatic adds, derivatives thereof, and the like, powdered metal salts thereof, and resin powders such as fluorine resin, polyethylene resin, acrylic resin, or the like. The average particle diameter of the powder is, for example, preferably 0.01 μm to 5 μm and is more preferably 0.1 μm to 2 μm.

There is no particular limitation on the process of manufacturing the toner, but it is preferably manufactured by a process comprising the steps of (i) forming cohesive particles in a dispersion of resin particles to manufacture a cohesive particle dispersion, (ii) adding a fine particle dispersion to the cohesive particle dispersion so that the fine particles adhere to the cohesive particles, thus forming adhesion particles, and (iii) heating the adhesion particles which melt to form toner particles.

-Physical Properties for Toner-

It is preferred that the volume average particle diameter of the toner is from 0.5 μm to 10 μm.

If the volume average particle diameter of the toner is too small, it may have an adverse effect on handling of the toner (supplementation, cleaning properties, fluidability, or the like), and productivity of the particles may deteriorate. On the other hand, if the volume average particle diameters is too large, it may have an adverse effect on image quality and resolution, both of which lead to granulariness and transferring properties.

It is preferred that the toner satisfies the above volume average particle diameter range, and that the volume average particle distribution index (GSDv) is 1.3 or less.

It is preferred that the ratio (GSDv/GSDn) of the volume average polymer distribution index (GSDv) and the number average partide distribution index (GSDn) is 0.95 or more.

It is preferred that the toner satisfies the volume average particle diameter range, and that the average value of the shape factor expressed by the following equation is 1.00 to 1.50:

$$\text{Shape factor}=(\pi\times L^2)/(4\times S)$$

(where, "L" is the maximum length of the toner particles, and "S" is the projection surface area of a toner particle).

If the toner satisfies the above conditions, it has a desirable effect on image quality, and in particular, on granulariness and resolution. Also, there is less risk of dropout and blur accompanying with toner transferring, and less risk of adverse effect on handling properties, even if the average particle diameter is not small.

The storage elastcity modulus G' (measured at an angular frequency of 10 rad/sec) of the toner itself at 150° C. is 10 Pa to 200 Pa, which is suitable for improving image quality and preventing offset at a fixing step.

The present invention will now be described in further detail with reference to the following Examples. The present invention is not limited thereto, however.

-Preparation of Support-

A broadleaf kraft pulp (LBKP) was beaten to 300 ml (Canadian standard freeness, C.S.F.) by a disk refiner, and adjusted to a fiber length of 0.58 mm, so as to prepare pulp paper material. Various additives were added to the pulp paper material in the following proportions, based on the mass of pulp.

| Additive type | Amount (%) |
|---|---|
| Cationic starch | 1.2 |
| Alkyl ketene dimer (AKD) | 0.5 |
| Anion polyacrylamide | 0.3 |
| Epoxidized fatty acid amide (EFA) | 0.2 |
| Polyamide polyamine epichlorhydrin | 0.3 |

Note:
In the alkyl ketene dimer (AKD), the alkyl moiety is derived from fatty acids mainly containing behenic acid. In the epoxidized fatty acid amide (EFA), the fatty acid moiety is derived from fatty acids mainly containing behenic acid.

A raw paper of basis weight of 150 g/m$^2$ was manufactured from the pulp paper material obtained using a Fortlinear paper machine. 1.0 g/m$^2$ PVA (polyvinyl alcohol) and 0.8 g/1$^2$ $CaCl_2$ were made to adhere thereto by a size press device in the middle of the drying zone of the Fortlinear paper machine.

In the last step of the paper-making process, the density was adjusted to 1.01 g/cm$^3$ using a soft calender. The paper was passed through so that the side (surface) of the raw paper whereon the toner image-receiving layer is provided, came into contact with the metal roller. The surface temperature of the metal roller was 140° C. The Oken type smoothness of the obtained raw paper was 265 seconds, and the Stökigt sizing degree was 127 seconds.

The above-prepared raw paper strip was subjected to corona discharge at a power of 17 kW. A single layer of a polyethylene resin having a composition shown in Table 1 was extruded and laminated onto the back side of the raw paper at a temperature of discharged fused film of 320° C. and at a line speed of 250 m/minute using a cooling roll with a surface matte roughness of 10 μm and thereby yielded a back side polyethylene resin layer 22 μm thick.

TABLE 1

| Composition | MFR (g/10-min) | Density (g/cm$^3$) | Amount of additive (mass %) |
|---|---|---|---|
| HDPE | 12 | 0.967 | 70 |
| LDPE | 3.5 | 0.923 | 30 |

Next, a single layer of a mixture of master batches was extruded and laminated onto the front side of the raw paper, on which the toner-image-receiving layer would be formed, at a line speed of 250 m/minute using a cooling roll with a surface matte roughness of 0.7 μm and thereby yielded a front side polyethylene resin layer 29 μm thick. The mixture of master batches had a final composition shown in Table 3, contained first master batch pellets containing the LDPE as in Table 1 and titanium dioxide ($TiO_2$) in a composition shown in Table 2, and second mast batch pellets containing 5% by mass of ultramarine blue. Then, the front side and the backside were subjected to corona discharge at a power of 18 kW and 12 kW, respectively, and a gelatin undercoat layer was formed on the front side so as to prepare a strip of support

TABLE 2

| Composition | Content (mass %) |
|---|---|
| LDPE (ρ = 0.921 g/cm$^3$) | 37.98 |
| Anatase titanium dioxide | 60 |
| Zinc stearate | 2 |
| Antioxidant | 0.02 |

TABLE 3

| Composition | Amount of additive (mass %) |
|---|---|
| LDPE (ρ = 0.921 g/cm$^3$) | 67.7 |
| Anatase titanium dioxide | 30 |
| Zinc stearate | 2 |
| Ultramarine | 0.3 |

To the front side of the above-prepared support strip, a coating composition for a toner image-receiving layer was applied to coated amounts shown in Table 4 using a bar coater and thereby yielded a strip of continuous electrophotographic image-receiving sheet. The coating composition contained an aqueous dispersion of a self-dispersible polyester resin, an aqueous dispersion of a carnauba wax, a poly(vinyl alcohol) (PVA) dispersion of titanium dioxide, a polyethylene oxide having a molecular weight of about 100000, and an anionic surfactant. The coating solution had the viscosity of 70 mPa s, the surface tension of 30 mN/m, and the pH of 7.8.

For the obtained electrophotographic image-receiving sheet, the front side bad a whiteness of 87, opacity of 93, and glossiness of 45 (20°), and the backside had a whiteness of 74 and glossiness of 3 (20°).

TABLE 4

| Composition | Amount of application (g/m$^2$) |
|---|---|
| Polyester resin | 11.0 |
| Carnauba wax | 1.2 |
| Anatase titanium dioxide | 1.1 |
| PVA-205 | 0.15 |
| Polyethylene oxide | 2.9 |
| Anionic surfactant | 0.3 |

The obtained strip of continuous electrophotographic image-receiving sheet was cut to a width of 127 mm and a length of 10 m, and then wound on a 2 inch-diameter core so as to obtain a roll of the electrophotographic sheet Then, using the obtained electrophotographic image-receiving sheet and an electrophotographic apparatus which is a full color laser printer (DCC-400) by Fuji Xerox Co., Ltd. as shown in FIG. 4 whose fixing unit is modified to a belt fixing unit with the belt fixing device shown in FIG. 5, fixing processes were performed as described hereafter.

-Belt-

Support of belt: Polyimide (PI) film, width=32 cm

Thickness=80 μm

Material of the release layer of the belt: SIFEL (a fluorocarbon siloxane rubber made by vulcanizing SIFEL 610, a fluorocarbon siloxane rubber precursor, available from Shin-Etsu Chemical Co., Ltd.)

Thickness=12 μm

-Cooling Process-

Cooling device: Heat sink length=120 mm

Transport Speed: 53 mm/sec

-Fixing Process-

Fixing temperature: 140° C.

Next, using the belt fixing device shown in FIG. 5, fixing was performed in the same manner as above, and the electrophotographic image-receiving sheet was stopped so that it stays at the fixing part, and thereby stains were formed on the fixing belt. The perimeter of the fixing belt was 58 cm.

EXAMPLE 1

In Example 1, the strip of electrophotographic image-receiving sheet was cut into a sheet having a length of about 70 cm in the direction of feeding so as to make an electrophotographic sheet (cleaning sheet), then the cleaning sheet was fed through the electrophotographic apparatus on which the stains were formed, and thus cleaning was conducted.

The result was that the number of sheets required for cleaning until no abnormality was observed on the belt was 3.

The temperature of the fixing part during cleaning was 135° C.

The transport speed at the fixing part during cleaning was 30 mm/sec.

EXAMPLE 2

In Example 2, the roll which was prepared as described above was loaded, fed through, and cut by a cutting means to a length (about 70 cm) which was about 1.2 times as long as the length of the belt, and thus cleaning of the electrophotographic apparatus on which the stains were formed was conducted.

The result was that the problem was almost cleared with 1 sheet, and abnormality could not be observed with the eye after 2 sheets.

The temperature of the fixing part during cleaning was 135° C.

The transport speed at the fixing part during cleaning was 30 mm/sec.

COMPARATIVE EXAMPLE 1

In Comparative Example 1, the strip of electrophotographic image-receiving sheet was cut into a sheet having a length of 29.7 cm in the direction of feeding so as to make an electrophotographic sheet (cleaning sheet), then the clearing sheet was fed through the electrophotographic apparatus on which the stains were formed, and thus cleaning was conducted.

The result was that the number of sheets required for cleaning until no abnormality was observed on the belt was 9.

The temperature of the fixing part during cleaning was 135° C.

The transport speed at the fixing part during cleaning was 70 mm/sec.

According to the present invention, it is possible to ensure easy cleaning of at least one of a fixing roller and a fixing belt in an electrophotographic apparatus by using an electrophotographic image-receiving sheet which has a toner image-receiving layer containing a thermoplastic resin as a cleaning sheet.

What is claimed is:

1. A process for cleaning, comprising:

heating and pressuring a cleaning sheet with a heating and pressuring means, the cleaning sheet being fed through an image forming apparatus such that stains are removed, wherein the heating and pressuring means is at least one of a fixing belt and a fixing roller; and the cleaning sheet has a support and a layer containing a thermoplastic resin over the support, wherein the cleaning sheet is in a form of a roll which is used after being cut so as to satisfy at least one of the following formulae:

L1 (cm)>L2 (cm) and

L1 (cm)>L3 (cm), wherein L1 is a length of the cleaning sheet in a direction of feeding the cleaning sheet, L2 a perimeter of the fixing roller, and L3 a perimeter of the fixing belt, and wherein the process satisfies at least one of the following formulae:

L2 (cm)>L4 (cm) and

L3 (cm)>L4 (cm)

wherein L2 and L3 are the same as L2 and L3 above, respectively, and L4 represents a length of a smallest electrophotographic image-receiving sheet in a direction of feeding the electrophotographic image-receiving sheet.

2. A process for cleaning according to claim 1, wherein the cleaning sheet is a same sheet as an electrophotographic image-receiving sheet which is used for the image forming apparatus.

3. A process for cleaning according to claim 1, wherein L1 is larger than one of L2 and L3 by from 0.5 cm to 15 cm.

4. A process for cleaning according to claim 1, wherein the stains comprise a thermoplastic resin which is adhered on the heating and pressuring means after fixing.

5. A process for cleaning according to claim 1, wherein a size of the cleaning sheet is selected from the group consisting of L-size, A6-size, A4-size, B4-size, A3-size, B5-size, postcard-size, and business card-size.

6. A process for cleaning according to claim 1, wherein the heating and pressuring means is a belt-fixing smoothing device which includes:

the fixing roller;

the fixing belt; and a cooling device.

7. A process for cleaning according to claim 1, wherein a fixing temperature at which toner is fixed on an electrophotographic image-receiving sheet in the image forming apparatus differs from a temperature during cleaning at a portion of the image forming apparatus where fixing is conducted.

8. A process for cleaning according to claim 1, wherein a transport speed when toner is fixed on an electrophotographic image-receiving sheet in the image forming apparatus differs from a transport speed during cleaning at a portion of the image forming apparatus where fixing is conducted.

9. A process for cleaning according to claim 1, wherein the fixing belt comprises:

a heat resistant support film; and a releasing layer formed over the support film.

10. A process for cleaning according to claim 9, wherein the releasing layer is one of a layer of fluorocarbon siloxane rubber and layers comprising a layer of silicone rubber and a layer of fluorocarbon siloxane rubber disposed in this sequence.

11. A process for cleaning according to claim 10, wherein the fluorocarbon siloxmne rubber comprises a main chain which includes at least one of a perfluoroalkyl ether group and a perfluoroalkyl group.

12. An image forming apparatus, comprising:

a heating and pressuring means which fixes toner on an electrophotographic image-receiving sheet which has a support and a toner image-receiving layer containing a thermoplastic resin on the support, wherein the heating and pressuring means is at least one of a fixing belt and a fixing roller; and a cleaning sheet for removing stains adhered on the heating and pressuring means, wherein the cleaning sheet is in a form of a roll, and the electrophotographic image-receiving sheet may be used as the cleaning sheet formed to a size satisfying at least one of the following formulae:

L1 (cm)>L2 (cm) and

L1 (cm)>L3 (cm), wherein L1 is a length of the cleaning sheet in a direction of feeding the cleaning sheet, L2 a perimeter of the fixing roller, and L3 a perimeter of the fixing belt, and wherein the image-forming apparatus satisfies at least one of the following formulae:

L2 (cm)>L4 (cm) and

L3 (cm)>L4 (cm)

wherein L2 and L3 are the same as L2 and L3 above, respectively, and L4 represents a length of a smallest electrophotograpbic image-receiving sheet in a direction of feeding the electrophotographic image-receving sheet.

13. An image forming apparatus according to claim 12, wherein L1 is larger than one of L2 and L3 by from 0.5 cm to 15 cm.

14. An image forming apparatus according to claim 12, wherein the heating and pressuring means is a belt-fixing smoothing device which includes:

the fixing roller;

the fixing belt; and a cooling device.

15. An image forming apparatus according to claim 12, further comprising a sheet cutting means which cuts the roll of cleaning sheet such that a sheet cut off from the roll satisfies at least one of the following formulae:

L1 (cm)>L2 (cm) and

L1 (cm)>L3 (cm).

* * * * *